US011583987B2

(12) United States Patent
Stoner et al.

(10) Patent No.: US 11,583,987 B2
(45) Date of Patent: Feb. 21, 2023

(54) IMPACT HAMMER SYSTEM

(71) Applicants: Raymond Stoner, Yuba City, CA (US); Christopher John Galloway, Davis, CA (US)

(72) Inventors: Raymond Stoner, Yuba City, CA (US); Christopher John Galloway, Davis, CA (US)

( * ) Notice: Subject to any disclaimer, the term of this patent is extended or adjusted under 35 U.S.C. 154(b) by 147 days.

(21) Appl. No.: 16/926,538

(22) Filed: Jul. 10, 2020

(65) Prior Publication Data

US 2020/0361070 A1 Nov. 19, 2020

Related U.S. Application Data

(63) Continuation-in-part of application No. 15/956,651, filed on Apr. 18, 2018, now Pat. No. 10,710,229.

(51) Int. Cl.

| | |
|---|---|
| ***B25D 9/04*** | (2006.01) |
| ***B25D 9/12*** | (2006.01) |
| *B25D 9/08* | (2006.01) |

(52) U.S. Cl.

CPC ..... *B25D 9/04* (2013.01); *B25D 9/12* (2013.01); *B25D 9/08* (2013.01); *B25D 2250/125* (2013.01)

(58) Field of Classification Search

CPC ..... B25D 9/12; B25D 2250/371; B25D 2250/095; B25D 11/04; B25D 9/10; B25D 9/04

USPC ..... 173/204, 202, 210, 133, 103, 90

See application file for complete search history.

(56) References Cited

U.S. PATENT DOCUMENTS

| | | | | |
|---|---|---|---|---|
| 2,317,158 | A | 4/1943 | Westover | |
| 2,500,402 | A | 3/1950 | Craig | |
| 3,439,755 | A | 4/1969 | Alexandrov | |
| 3,642,077 | A | 2/1972 | Bayard | |
| 6,223,834 | B1 | 5/2001 | Takamura et al. | |
| 6,523,622 | B1 | 2/2003 | Berger et al. | |
| 8,657,028 | B2 | 2/2014 | Stoner et al. | |
| 10,710,229 | B2 * | 7/2020 | Stoner | B25D 9/04 |
| 2006/0237206 | A1 | 10/2006 | Schamberger et al. | |
| 2010/0252289 | A1 | 10/2010 | Aoki | |
| 2013/0048326 | A1 | 2/2013 | Stoner et al. | |
| 2019/0321957 | A1 * | 10/2019 | Stoner | B25D 9/04 |

* cited by examiner

*Primary Examiner* — Robert F Long
*Assistant Examiner* — Xavier A Madison
(74) *Attorney, Agent, or Firm* — Carr & Ferrell LLP

(57) ABSTRACT

A hydraulic, pneumatic, gasoline, diesel, or electric tool may include a spindle that is adapted for rotational movement. A swing arm may be coupled to the spindle such that rotational motion of the spindle is transferred to the swing arm. The swing arm makes contact with a piston such that the rotational motion causes the piston to move along a linear path. The piston may interact with an energy storage medium when the swing arm moves the piston in the first direction, causing energy to be stored in the energy storage medium. As the swing arm continues to rotate, the swing arm may lose contact with the piston, thus allowing the energy storage medium to urge the piston in a second direction opposite the first direction to strike an anvil. The swing arm may be a multiple roller swing arm. The energy storage medium may be a compound spring assembly.

16 Claims, 19 Drawing Sheets

Offset Countersunk spring arrangement

IMPACT HAMMER SYSTEM

CROSS REFERENCE TO RELATED APPLICATION

This Patent Application is a continuation-in-part of, and claims the benefit of, U.S. patent application Ser. No. 15/956,651, filed Apr. 18, 2018, entitled "Impact Hammer". The aforementioned disclosure is hereby incorporated by reference herein in its entirety including all references and appendices cited therein.

FIELD OF THE INVENTION

The present invention is generally directed to pneumatic, hydraulic, gasoline, diesel, and electric driven impact tools, and is more specifically directed to an energy saving impact hammer.

BACKGROUND

A wide variety of pneumatic, hydraulic, gasoline, diesel, and electric driven impact tools are used throughout manufacturing and construction. Most of these tools can trace their origins back to the invention of the jackhammer in the late 1800's and operate under the principle of storing energy via a compressed gas or utilizing a pressurized fluid, then releasing the stored energy to perform useful work. Others operate employing the reciprocating piston principle. Common tools include jackhammers, pneumatic impact wrenches, pneumatic rock drills, post drivers, nail guns, and pile driving equipment. Due to the structural requirements of utilizing high pressure fluids or large volumes of compressed air, these tools are generally heavy, bulky, relatively expensive, and require large quantities of energy to operate.

Hydraulic breakers of various sizes work on the principle of moving a piston against a reactive force (commonly provided by a spring source) and then releasing the piston to facilitate an impact. With this design, oil or other fluids may be used to stroke a hydraulic cylinder which is incorporated as part of the piston. The hydraulic fluid lifts the piston thereby compressing a gaseous spring. The oil is then released, and the piston is propelled to an impact. A drawback of this design is that a valve must be actuated and the oil evacuated with each stroke or impact of the piston, resulting in a parasitic load that consumes a portion of the stored energy and reduces the efficiency of the jackhammer. Additionally, as the piston nears the end of its stroke, it is decelerated as the oil cushions the movement and the valve begins to actuate for the next lift cycle, thus diminishing the impact of the piston. To counter these losses, higher reactive forces or hydraulic pressures may be used, which requires greater energy input, structurally stronger equipment, and increased maintenance, thereby resulting in a shorter tool life.

Electric breakers and gasoline-powered breakers (petrol breakers) work on the reciprocating principle. A cylinder is moved up and down rapidly by means of a crankshaft and rod. A snug fitting piston is placed inside the cylinder and as the cylinder is moved upward, a vacuum is created that lifts the piston. As the cylinder is then forced downward via the crankshaft and rod, the piston is forced downward as well. Once the cylinder passes half stroke (the point of maximum acceleration), it begins to slow. The piston continues in a free body motion until the point of impact. Once the cylinder begins to slow, the piston is no longer accelerated, resulting in a limited impact force.

Pneumatic hammers of all sizes employ a piston within a cylinder. A pulse of compressed air pushes the piston upward until the piston contacts a valve. The valve then opens, allowing a large pulse of compressed air to accelerate the piston downward producing an impact on a work tool. One drawback of pneumatic hammers is the requirement for large quantities of compressed air, which requires energy intensive compressors. A second drawback of pneumatic hammers is the noise and air pollution associated with releasing compressed air and the running of large compressors.

SUMMARY

Various embodiments of the present application are directed to pneumatic, hydraulic, gasoline, diesel, and electric driven tools, specifically an impact hammer. An exemplary impact hammer includes a spindle that is adapted for rotational movement. A swing arm is coupled to the spindle such that the rotational motion of the spindle is transferred to the swing arm. The swing arm makes contact with a contact surface of a piston such that the rotational motion of the swing arm causes the piston to move in a first direction along a linear path. In some embodiments, the swing arm may be a multiple roller swing arm. The piston is adapted to interact with an energy storage medium when the swing arm moves the piston in the first direction, thereby causing energy to be stored in the energy storage medium. The energy storage medium may be a compound spring assembly with a plurality of spring stacks including a plurality of offset and counter sunk springs stacked in series allowing for maximum use of spring deflection while minimizing spring free length. As the swing arm continues to rotate, the swing arm may lose contact with the contact surface of the piston, thus allowing the plurality of offset and counter sunk springs of the compound spring assembly to urge the piston in a second direction opposite the first direction allowing the piston to strike an anvil impact surface. In various embodiments, the spindle and multiple roller swing arm is incorporated into a gear reducer.

DETAILED DESCRIPTION

The present application is directed to pneumatic, hydraulic, gasoline, diesel, and electric tools, specifically an impact hammer. Various embodiments comprise a spindle that is adapted for rotational movement. A swing arm is coupled to the spindle such that the rotational motion of the spindle is transferred to the swing arm. The swing arm may make contact with a contact surface of a piston such that the rotational motion of the swing arm causes the piston to move in a first direction along a linear path. In some embodiments, the swing arm may be a multiple roller swing arm. The piston is adapted to interact with an energy storage medium when the swing arm moves the piston in the first direction, thereby causing energy to be stored in the energy storage medium. The energy storage medium may be a compound spring assembly with a plurality of spring stacks, the plurality of spring stacks including a plurality of offset and counter sunk springs stacked in series. The plurality of offset and counter sunk springs allowing for maximum use of spring deflection while minimizing spring free length. As the swing arm continues to rotate, the swing arm may lose contact with the contact surface of the piston, thus allowing the plurality of offset and counter sunk springs of the compound spring assembly to urge the piston in a second direction opposite the first direction allowing the piston to strike an anvil impact surface. In some embodiments, the spindle and multiple roller swing arm may be incorporated directly into a gear reducer.

Figures 1A, 1B, 1C:
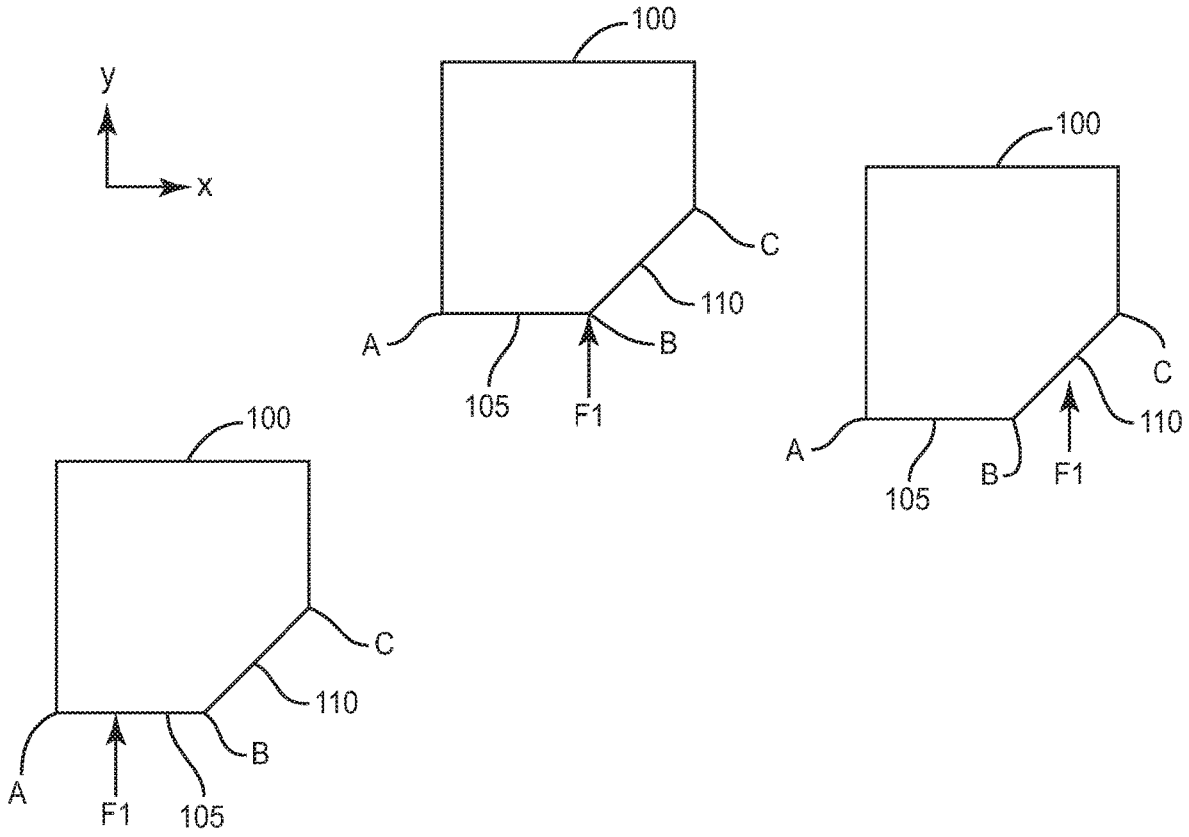
FIGS. 1A through 1C are schematic diagrams of an exemplary anvil, according to embodiments of the present technology.

In some embodiments, the piston is operatively coupled to the anvil to follow the linear movement of the anvil (as shown in FIGS. 1A through 1C).

In various embodiments, the swing arm may make contact with a contact surface of an anvil such that the rotational motion of the swing arm causes the anvil to move in a first direction along a linear path (as shown in FIGS. 1A through 1C). In various embodiments, the swing arm may make contact with a contact surface of a piston such that the rotational motion of the swing arm causes the piston to move in a first direction along a linear path (e.g., as shown in FIGS. 3A through 3D for a single roller swing arm and in FIGS. 4A through 4D for a multiple roller swing arm).

FIGS. 1A through 1C schematically illustrate the operation of various embodiments of an impact hammer. In FIG. 1A, an anvil 100 comprises a contact surface 105 and a ramp off surface 110. Point A represents a point on the contact surface 105 farthest away from the ramp off surface 110, and point B represents a point on the contact surface 105 in closest proximity to the ramp off surface 110. The ramp off surface 110 may be oriented at an angle $\alpha$(see FIG. 8) with respect to the contact surface 105. A motive force F1 may act upon the contact surface 105, causing the anvil 100 to move in the positive y-direction as indicated in FIG. 1A. The force F1 may also be free to move laterally in the positive x-direction as indicated in FIG. 1A.

In FIG. 1B, the force F1 has caused the anvil 100 to move in the positive y-direction in relation to the position of the anvil 100 in FIG. 1A. In addition, the force F1 has moved across the contact surface 105 away from point A into proximity with point B. As the force F1 reaches point B, the anvil 100 has reached a maximum distance traveled in the positive y-direction. In various embodiments, the force F1 may also be restrained from acting upon the anvil 100 any further in the positive y-direction than as illustrated in FIG. 1B.

As the force F1 moves further in the positive x-direction and passes beyond point B as illustrated in FIG. 1C, the force F1 may lose contact with the contact surface 105 because the angle $\alpha$ of the ramp off surface 110 positions the ramp off surface 110 beyond the reach of the force F1 in the positive y-direction. Thus, once the force F1 moves beyond point B in the positive x-direction, the anvil 100 is free to now move in the negative y-direction back to its starting position as indicated in FIG. 1A. In various embodiments, the force F1 may continue to move in the positive x-direction or move in the negative y-direction, or both, at a speed great enough to avoid contact with the ramp off surface 110 as point C approaches the force F1. In various other embodiments, the ramp off surface 110 may contact the force F1 as the anvil 100 moves in the negative x-direction.

In various embodiments a multiple roller swing arm makes contact with a contact surface of the piston. In contrast to some embodiments of the anvil 100, various embodiments of the contact surface of the piston may not have a ramp off surface 110. Thus, as the force F1 moves further in the positive x-direction and passes beyond point B as illustrated in FIG. 1C, the force F1 may lose contact with the contact surface 105 because there may be no ramp off surface 110. Thus, facilitating a movement of the piston in the −y direction without the opposed roller contacting the piston contact surface until the piston has reached the maximum travel in the −y direction. Thus, the contact surface of the piston may be smaller than the contact surface 105 of the anvil 100.

FIGS. 2A through 2E further illustrate a cycle of operation of various embodiments in which a swing arm 205 operatively coupled to a spindle 200 imparts the force F1 on the anvil 100. In the embodiments of FIGS. 2A through 2E, the anvil 100 may be operatively attached to a piston 210. At least a portion of the anvil 100, piston 210, spindle 200, and swing arm 205 may be positioned within a housing 215. The housing 215 acts to restrict movement of the anvil 100 and piston 210 in the upward and downward directions (as depicted in FIGS. 2A through 2E, "upward" is understood to mean towards the top of the figure, and "downward" is understood to mean towards the bottom of the figure). The housing 215 may contain a chamber 225 to contain an energy storage medium, the function of which is explained in detail below. The housing 215 may further incorporate at least a portion of a work tool 230 upon which the anvil 100 may act.

Figure 2C:
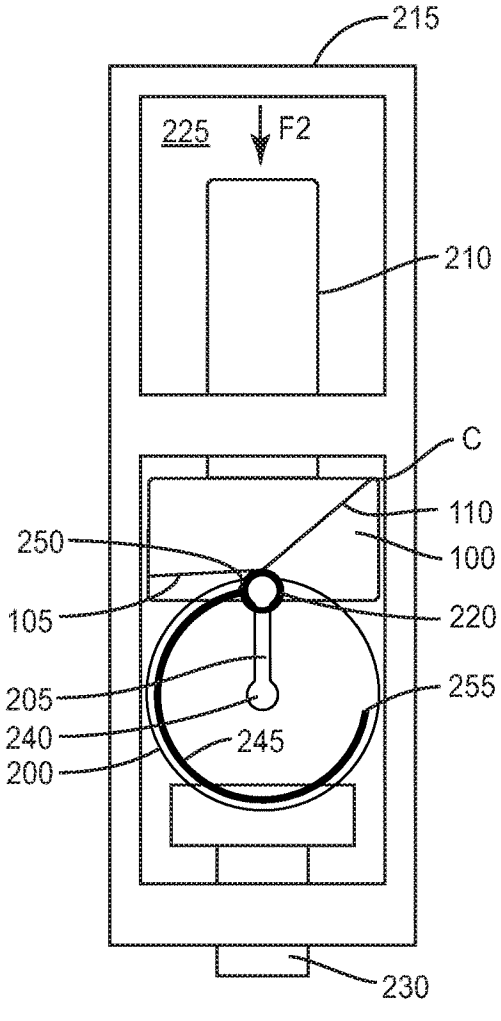
FIGS. 2A through 2E are schematic diagrams illustrating operation of an exemplary impact hammer, according to embodiments of the present technology.
Figure 2B:
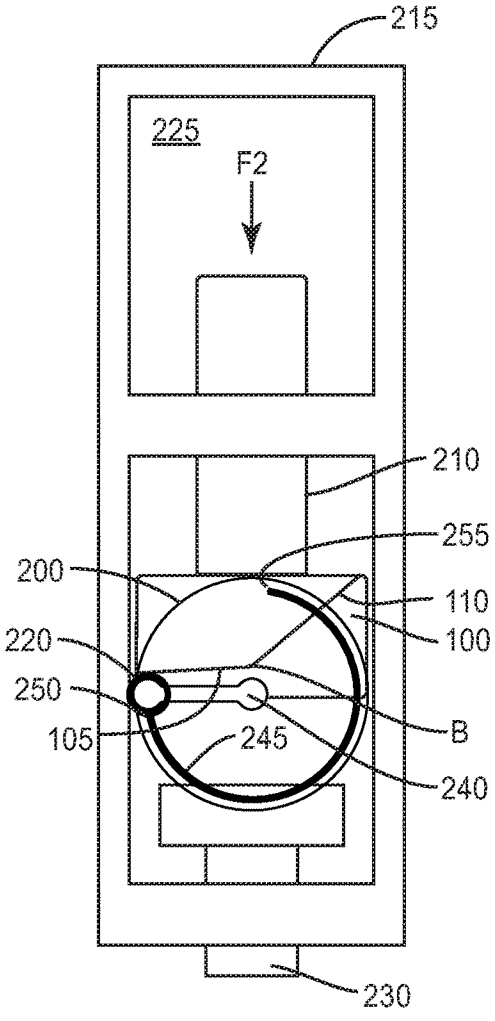
Figure 2A:
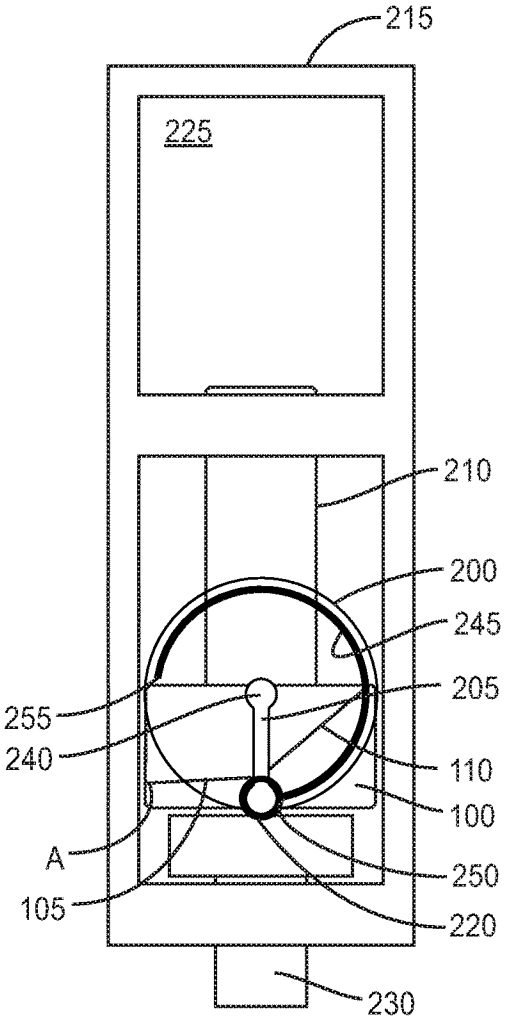

FIG. 2A illustrates the starting point of the cycle of operation according to various embodiments. A secured end 240 of the swing arm 205 is coupled to the spindle 200 such that rotation of the spindle 200 causes a corresponding rotation of the swing arm 205. The secured end 240 may be coupled to the spindle by a bearing 305 (see FIG. 5) that allows the swing arm 205 to freely rotate. Alternately, the secured end 240 may be coupled to the spindle by a gear reducer (see FIGS. 9A through 9D) and may be incorporated in the gear reducer that allows the swing arm 205 to freely rotate. Opposite the secured end 240 of the swing arm 205 is a free end 235. A contact bushing 220 may be attached to the free end 235 to act as a roller bearing for contact with the contact surface 105 of the anvil 100. At the starting point of the cycle, the swing arm 205 is in a downward position such that the free end 235 of the swing arm is at a lowest position. At this position, the contact bushing 220 may or may not be in contact with the contact surface 105 of the anvil 100. As the spindle 200 begins to rotate, the first swing arm stop 250 may contact the swing arm 205 in proximity to the free end 235. Contact thus made between the first swing arm stop 250 and the swing arm 205, the swing arm 205 begins to rotate with the spindle 200.

In FIG. 2B, the spindle 200 rotates in a clockwise direction causing the swing arm 205 to rotate accordingly. The contact bushing 220 may contact the contact surface 105 in proximity to point A, imparting force F1 (see FIGS. 1A through 1C) on the contact surface 105 causing the anvil 100 to move in an upwards direction along a linear path. The upward movement of the anvil 100 in turn causes the piston 210 to extend into the chamber 225 and compress the energy storage medium. Compression of the energy storage medium imparts a force F2 that urges the piston 210 in a downward direction. In general, force F2 acts in the opposite direction of force F1.

Further rotation of the spindle 200 may cause the swing arm 205 to extend upward as illustrated in FIG. 2C. In this position, the contact bushing 220 is positioned in proximity to point B on the contact surface 105, and the anvil 100 is at a highest position. Similarly, the piston 210 is extended a maximum amount into the chamber 225 and maximum compression of the energy storage medium may be obtained. The force F2 urging the piston 210 downward may also reach a maximum at this point of the cycle.

As the spindle 200 and swing arm 205 continue to rotate, the contact bushing 220 moves beyond point B on the contact surface 105 and begins to approach the ramp off surface 110 of the anvil 100. The ramp off surface 110 is angled in such a way as to urge the contact bushing 220 and the swing arm 205 away from the first swing arm stop 250. At this point, the force F1 exerted by the swing arm 205 approaches zero and force F2 begins to control movement of the piston 210 and anvil 100. Once the contact bushing 220 loses contact with the contact surface 105 as illustrated in FIG. 2D, force F2 is free to act upon the piston 210 and urge the piston 210 and anvil 100 downward. The ramp off surface 110 may also contact the contact bushing 220 and urge the contact bushing 220 further away from the first swing arm stop 250 and closer to the second swing arm stop 255.

Figure 2E:
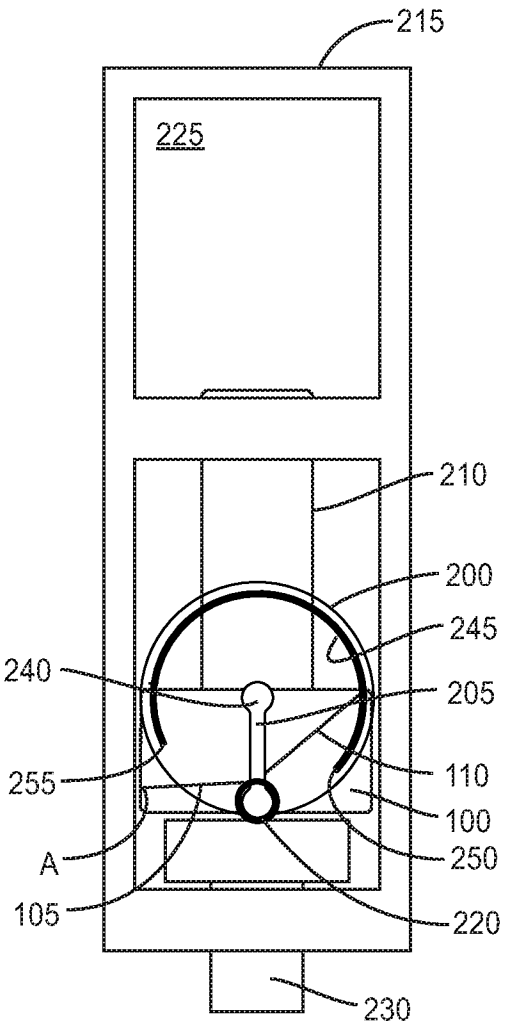
Figure 2D:
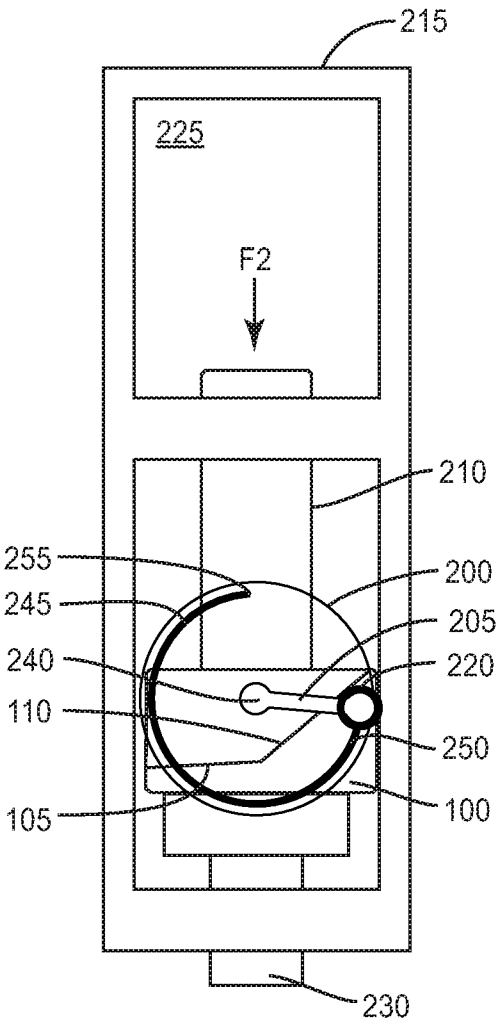

In FIG. 2E, force F2 may no longer be acting upon the piston 210 as at least a portion of the potential energy stored in the energy storage medium has been converted to kinetic energy in the movement of the piston 210 and anvil 100. The anvil 100 may make contact with the work tool 230, transferring at least a portion of the kinetic energy to the work tool 230. The anvil 100, spindle 200, and swing arm 205 may now be back in the starting position of the cycle and may repeat the cycle at FIG. 2A.

While FIGS. 2A through 2E depict clockwise movement of the spindle 200, one skilled in the art would readily envision that counterclockwise movement is within the scope of the present disclosure. For counterclockwise movement, the ramp off surface 110 may be positioned on the left side of the anvil 100 rather than the right side as depicted in FIGS. 2A through 2E. As the anvil 100 rotates counterclockwise, the second swing arm stop 255 may contact the swing arm 205, and the cycle would proceed as described above.

The amount of energy transferred to the work tool 230 is directly related to the force F2 acting upon the piston 210. The magnitude of the force F2 may be related to the amount of work done by the piston 210 on the energy storage medium, as the potential energy stored in the energy storage medium is related to the amount of work done by the piston 210. The amount of work done by the piston 210 is related to at least two factors: a length of the piston 210 and a length of the swing arm 205. The length of the piston 210 may determine how far into the chamber 225 the piston 210 extends, thereby controlling the amount of work done on the energy storage medium. For example, when a spring is used as the energy storage medium, the amount of compression of the spring may determine the magnitude of the force F2 urging the piston 210 downward. Thus, the amount of energy transferred to the work tool 230 may be varied by varying the length of the piston 210. Similarly, the length of the swing arm 205 may determine how far the piston 210 extends into the chamber 225. As can be seen in FIG. 2C, a longer swing arm 205 may move the anvil 100 and piston 210 further upward, and a shorter swing arm 205 may move the anvil 100 and piston 210 a shorter distance upward. Thus, just as varying the length of the piston 210 may vary the magnitude of the force F2, varying the length of the swing arm 205 may also vary the magnitude of the force F2.

Figures 3A, 3B, 3C, 3D:
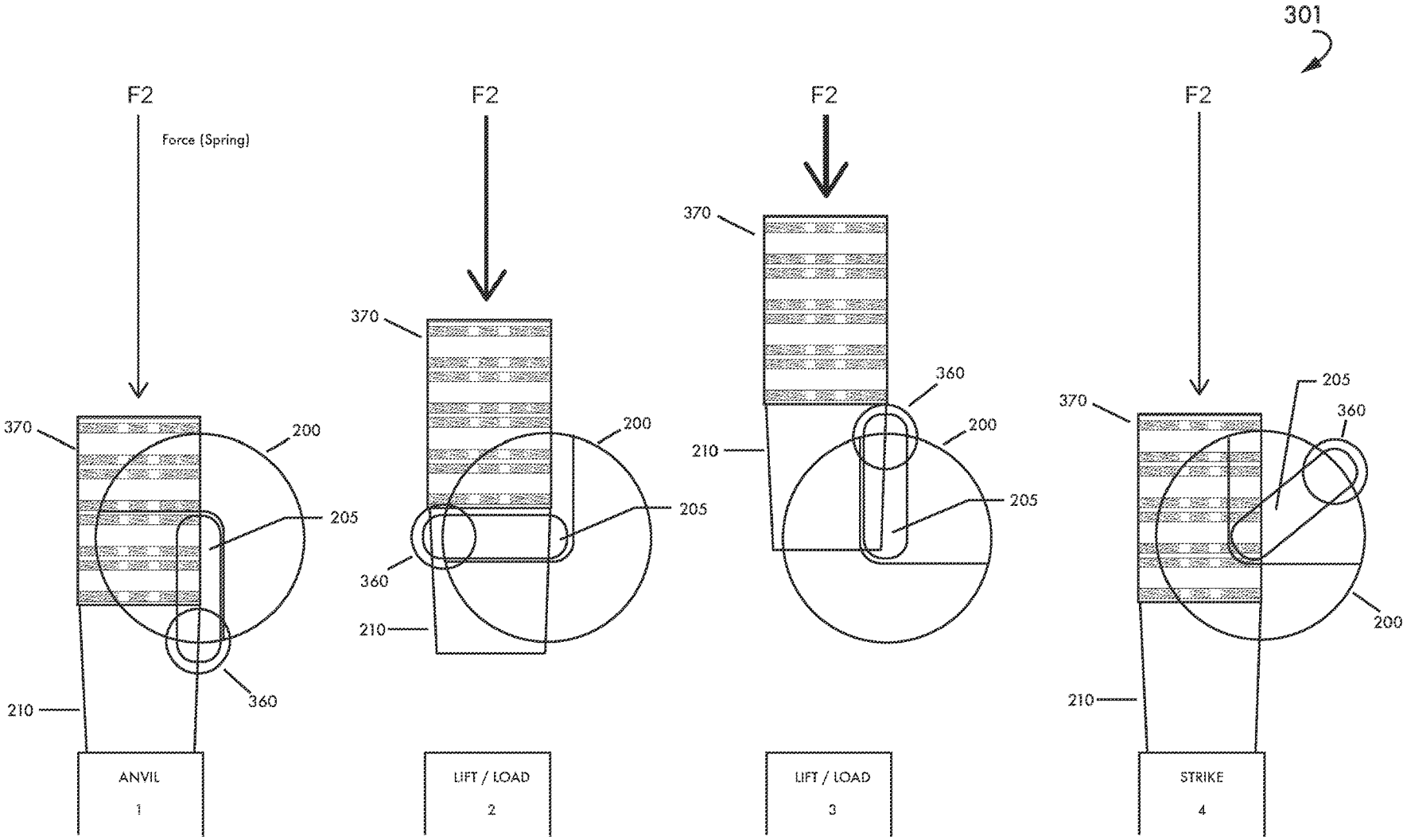
FIGS. 3A through 3D are schematic diagrams illustrating operation of an exemplary impact hammer with a single roller swing arm, according to embodiments of the present technology.

FIGS. 3A through 3D are schematic diagrams illustrating operation of an exemplary impact hammer with a single roller swing arm, according to embodiments of the present technology. In FIG. 3A, the swing arm 205 engages and lifts the piston 210 off of an anvil. In FIG. 3B, the swing arm 205 lifts the piston 210 and compresses energy storage medium 370 (e.g., a compact spring assembly (as shown), see FIGS. 11A through 11C and FIGS. 12A through 12C). In FIG. 3C, the swing arm 205 disengages from the piston 210 allowing the piston to accelerate and strike the anvil. In FIG. 3D, the swing arm 205 rotates 180 degrees and resets for reengagement with the piston 210 as the piston 210 strikes the anvil.

FIGS. 3A through 3D further illustrate a cycle of operation 301 of various embodiments in which a swing arm 205 operatively coupled to a spindle 200 imparts the force F1 on the piston 210. In embodiments of FIGS. 3A through 3D, the swing arm 205 is operatively coupled to the piston 210. In contrast, in the embodiments of FIGS. 2A through 2E, the anvil is operatively coupled to the piston 210. The piston 210 moves in the upward and downward directions (as depicted in FIGS. 3A through 3D, "upward" is understood to mean towards the top of the figure, and "downward" is understood to mean towards the bottom of the figure). The piston 210 acts on an energy storage medium 370, the function of which is explained in detail below.

FIG. 3A illustrates the starting point of the cycle of operation 301 according to various embodiments. A secured end of the swing arm 205 is coupled to the spindle 200 such that rotation of the spindle 200 causes a corresponding rotation of the swing arm 205. At the starting point of the cycle of operation 301, the swing arm 205 is in a downward position such that a swing arm to piston engagement roller 360 is at a lowest position and the piston 210 is in contact with a contact surface of the anvil. The free end of the swing arm is shown with the swing arm to piston engagement roller 360 at a lowest position. As the spindle 200 begins to rotate, the swing arm to piston engagement roller 360 may contact the piston 210 on a piston contact surface.

In FIG. 3B, the spindle 200 rotates in a clockwise direction causing the swing arm 205 to rotate accordingly. The swing arm to piston engagement roller 360 may contact the piston 210, imparting force F1, causing the piston 210 to move in an upwards direction along a linear path. The upward movement of the piston 210 in turn compresses the energy storage medium 370. In various embodiments, the energy storage medium 370 is a compact spring assembly (as shown) including a plurality of offset and counter sunk springs stacked in series (e.g., see FIGS. 11A through 11C and FIGS. 12A through 12C). In various embodiments, compression of the energy storage medium 370 imparts a force F2 that urges the piston 210 in a downward direction. In general, force F2 acts in the opposite direction of force F1.

Further rotation of the spindle 200 may cause the swing arm 205 to extend upward as illustrated in FIG. 3C. In this position, the swing arm to piston engagement roller 360 is at a highest position. Similarly, the piston 210 is extended a maximum amount and maximum compression of the energy storage medium 370 may be obtained. The force F2 urging the piston 210 downward may also reach a maximum at this point of the cycle of operation 301.

As the spindle 200 and swing arm 205 continue to rotate, the swing arm to piston engagement roller 360 may lose contact with the piston 210. At this point, the force F1 exerted by the swing arm 205 approaches zero and force F2 begins to control movement of the piston 210. Once the swing arm to piston engagement roller 360 loses contact with the contact surface of the piston, force F2 is free to act upon the piston 210 and urge the piston 210 downward. The stored energy in the energy storage medium 370 may be at a maximum (i.e., the potential energy in the compact spring assembly (as shown) may be at a maximum.)

In FIG. 3D, at least a portion of the potential energy stored in the energy storage medium 370 has been converted to kinetic energy in the movement of the piston 210 by force F2. The piston 210 may strike the anvil, that may contact a work tool (not shown), transferring at least a portion of the kinetic energy to the work tool. The piston 210 may now be back in the starting position of the cycle of operation 301 and may repeat the cycle of operation 301 at FIG. 3A. The amount of energy transferred to the work tool (not shown) is directly related to the force F2 acting upon the piston 210. The 180 degrees of rotation of the swing arm 205 to reset is wasting 50 percent of available energy. For example, 2 inch of stroke at 400 lb. load, 600 times per minute equals 1.25 HP (per horsepower definition). As shown in FIGS. 3A through 3D, using a swing arm having a single roller, 2 inch of stroke at 400 lbs. load, 600 RPM (600 times per minute) requires 3.8 HP.

Figures 4A, 4B, 4C, 4D:
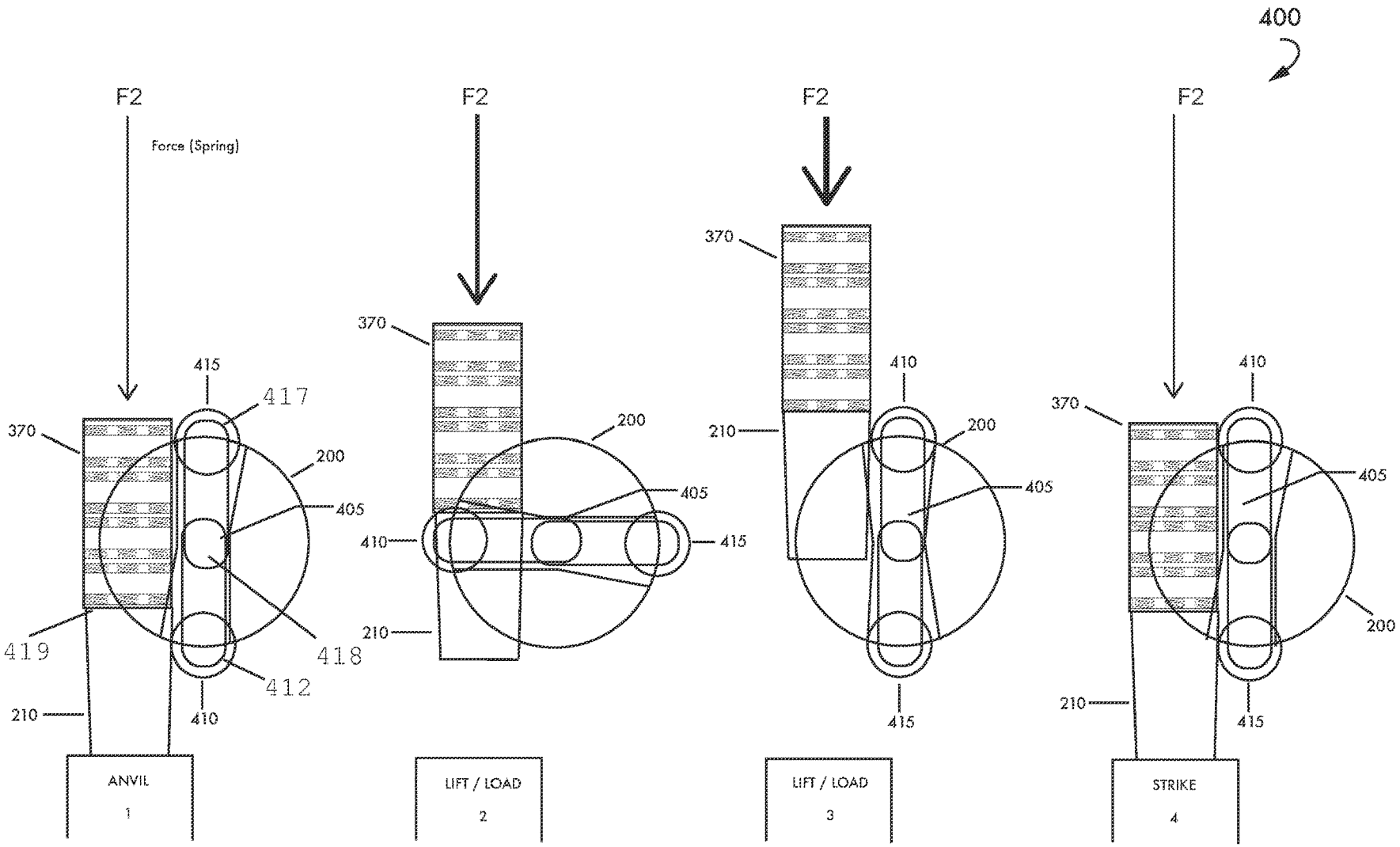
FIGS. 4A through 4D are schematic diagrams illustrating operation of an exemplary impact hammer with a multiple roller swing arm, according to embodiments of the present technology.

FIGS. 4A through 4D are schematic diagrams illustrating operation of an exemplary impact hammer with a multiple roller swing arm 405, according to embodiments of the present technology. The multiple roller swing arm 405 includes a first swing arm to piston engagement roller 410 and a second swing arm to piston engagement roller 415. In FIG. 4A, the first swing arm to piston engagement roller 410 of the multiple roller swing arm 405 lifts the piston 210 off of an anvil. FIG. 4A also shows the first swing arm to piston engagement roller 410 and the second swing arm to piston engagement roller 415 connected to a first end 412 and a second end 417, respectively. In FIG. 4B, the first swing arm to piston engagement roller 410 of the multiple roller swing arm 405 lifts the piston 210 and compresses the energy storage medium (e.g., a compact spring assembly, see FIGS. 11A through 11C and FIGS. 12A through 12C). In FIG. 4C, the first swing arm to piston engagement roller 410 of the multiple roller swing arm 405 disengages from the piston 210 allowing the piston 210 to accelerate and strike the anvil. In FIG. 4D, the multiple roller swing arm 405 rotates for reengagement with the piston 210 by the second swing arm to piston engagement roller 415 lifting the piston a second time in a single rotation of the spindle 200.

FIGS. 4A through 4D further illustrate a cycle of operation 400 of various embodiments in which the multiple roller swing arm 405 operatively coupled to a spindle 200 imparts the force F1 on the piston 210. The multiple roller swing arm 405 of FIGS. 4A through 4D, works similar to the design shown in FIGS. 3A through 3D for a single roller swing arm except with the use of the multiple roller swing arm 405 that includes the first swing arm to piston engagement roller 410 and the second swing arm to piston engagement roller 415. The attachment point 418 of the multiple roller swing arm 405 may be incorporated to a gear of the spindle (e.g., see FIGS. 9A through 9C) that allows the multiple roller swing arm 405 to freely rotate. The amount of energy transferred to the work tool (not shown) is directly related to the force F2 acting upon the piston 210. A swing arm having multiple rollers (e.g., the first swing arm to piston engagement roller 410 and the second swing arm to piston engagement roller 415), does not need a 180 degrees of rotation to reset. Thus, 50 percent of available energy is not wasted. In various embodiments, using the design shown in FIGS. 4A through 4D, only approximately 17 percent of the available energy is lost to nonproductive motion. For example, 2 inch of stroke at 400 lb. load, 600 times per minute equals 1.25 HP (per horsepower definition). As shown in FIGS. 4A through 4D, 2 inch of stroke 400 lb. load at 300 RPM (moving the piston 600 times per minute) requires 1.9 HP.

FIG. 4A illustrates the starting point of the cycle of operation 400 according to various embodiments. An attachment point 418 of the multiple roller swing arm 405 is coupled to the spindle 200 such that rotation of the spindle 200 causes a corresponding rotation of the multiple roller swing arm 405 including a first swing arm to piston engagement roller 410 and a second swing arm to piston engagement roller 415. At the starting point of the cycle of operation 400, the first swing arm to piston engagement roller 410 of the multiple roller swing arm 405 is in a downward position such that the first swing arm to piston engagement roller 410 is at a lowest position and the piston 210 is in contact with a contact surface of an anvil. As the spindle 200 begins to rotate, the first swing arm to piston engagement roller 410 of the multiple roller swing arm 405 may contact the piston 210 at a piston contact surface 419.

In FIG. 4B, the spindle 200 rotates in a clockwise direction causing the multiple roller swing arm 405 to rotate accordingly. The first swing arm to piston engagement roller 410 of the multiple roller swing arm 405 may contact the piston 210, imparting force F1, causing the piston 210 to move in an upwards direction along a linear path. The upward movement of the piston 210 in turn compresses the energy storage medium 370. In various embodiments, the energy storage medium 370 is a compact spring assembly (as shown) including spring stacks of a plurality of offset and counter sunk springs (e.g., see FIGS. 11A through 11C and FIGS. 12A through 12C). In various embodiments, compression of the energy storage medium 370 imparts a force F2 that urges the piston 210 in a downward direction. In general, force F2 acts in the opposite direction of force F1.

Further rotation of the spindle 200 may cause the first swing arm to piston engagement roller 410 of the multiple roller swing arm 405 to extend upward as illustrated in FIG. 3C. In this position, the first swing arm to piston engagement roller 410 of the multiple roller swing arm 405 is at a highest position and the second swing arm to piston engagement roller 415 is at a lowest position. Similarly, the piston 210 is extended a maximum amount and maximum compression of the energy storage medium 370 may be obtained. The force F2 urging the piston 210 downward may also reach a maximum at this point of the cycle of operation 400.

As the spindle 200 and the multiple roller swing arm 405 continue to rotate, the first swing arm to piston engagement roller 410 of the multiple roller swing arm 405 may lose contact with the piston 210. At this point, the force F1 exerted by the multiple roller swing arm 405 approaches zero and force F2 begins to control movement of the piston 210. Once the first swing arm to piston engagement roller 410 of the multiple roller swing arm 405 loses contact with the contact surface of the piston, force F2 is free to act upon the piston 210 and urge the piston 210 downward. The stored energy in the energy storage medium 370 may be at a maximum (i.e., the potential energy in the compact spring assembly (as shown) may be at a maximum.)

In FIG. 3D, at least a portion of the potential energy stored in the energy storage medium 370 has been converted to kinetic energy in the movement of the piston 210 by force F2. The piston 210 may strike the anvil, that may contact a work tool (not shown), transferring at least a portion of the kinetic energy to the work tool. In contrast to a single roller swing arm of FIGS. 3A through 3D, the multiple roller swing arm 405 of FIGS. 4A through 4D does not require 180 degrees of rotation for the multiple roller swing arm 405 to reset because the second swing arm to piston engagement roller 415 is in position to engage the piston 210. Thus, 50 percent of available energy is not wasted. The exemplary embodiments shown in FIGS. 4A through 4D shows the first swing arm to piston engagement roller 410 and the second swing arm to piston engagement roller 415 placed at 180 degrees opposite of the other along a liner axis resulting in the second swing arm to piston engagement roller 415 of the multiple roller swing arm 405 being ready for engagement with the piston 210 at approximately the same time that the piston reaches the limit of linear movement in the second direction. For example, the decrease in rotation for reengagement of the multiple roller swing arm 405 with the piston 210 results in energy savings of approximately 50%. For instance, to achieve 600 cycles per minute of the piston 210 with one roller, a single roller swing arm must travel in a rotational motion 600 times per minute. More efficiently, to achieve the same 600 cycles per minute of the piston 210 with two rollers placed 180 degrees apart from the other along a liner axis, the multiple roller swing arm 405 must travel 300 rotations per minute, resulting in 50% energy savings. Multiple roller design is not limited to two rollers placed at 180 degrees apart. Various embodiments of the multi roller configuration could include addition rollers equally placed in the swing arm as to achieve further efficiencies in the transfer of rotational force into linear force.

Figure 5:
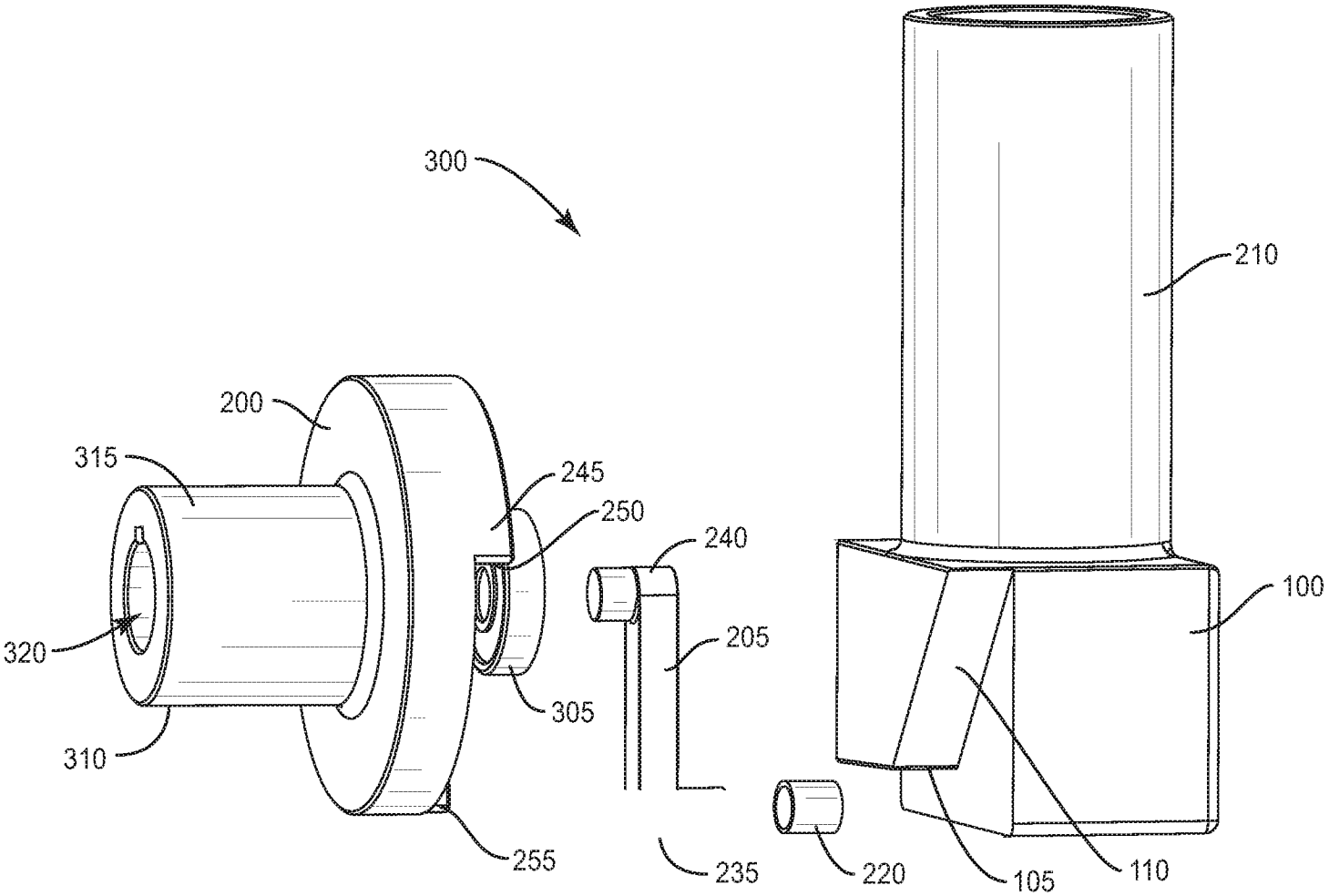
FIG. 5 is an exploded view of an exemplary spindle, swing arm, and anvil, according to embodiments of the present technology.

FIG. 5 illustrates an exploded view of an impactor assembly 300 according to various embodiments as shown schematically in FIGS. 2A through 2E. In this embodiment, the spindle 200 comprises a power transfer member 310 coaxially arranged with the spindle 200. In some embodiments, the power transfer member 310 may be utilized to impart a rotational force on the spindle 200. For example, a belt drive (not shown) may be placed around an outer surface 315 of the power transfer member 310. The belt may be driven by any type of motor or rotational device that causes movement of the belt. Movement of the belt may then cause the spindle 200 and power transfer member 310 to rotate. In other embodiments, a shaft of a motor (not shown) may be directly coupled to the power transfer member 310 via mounting hole 320 or a gear assembly (e.g., see FIGS. 9A through 9C). In still other embodiments, a source of rotational power may be directly coupled to the spindle 200 without the intervening power transfer member 310.

Figure 6:
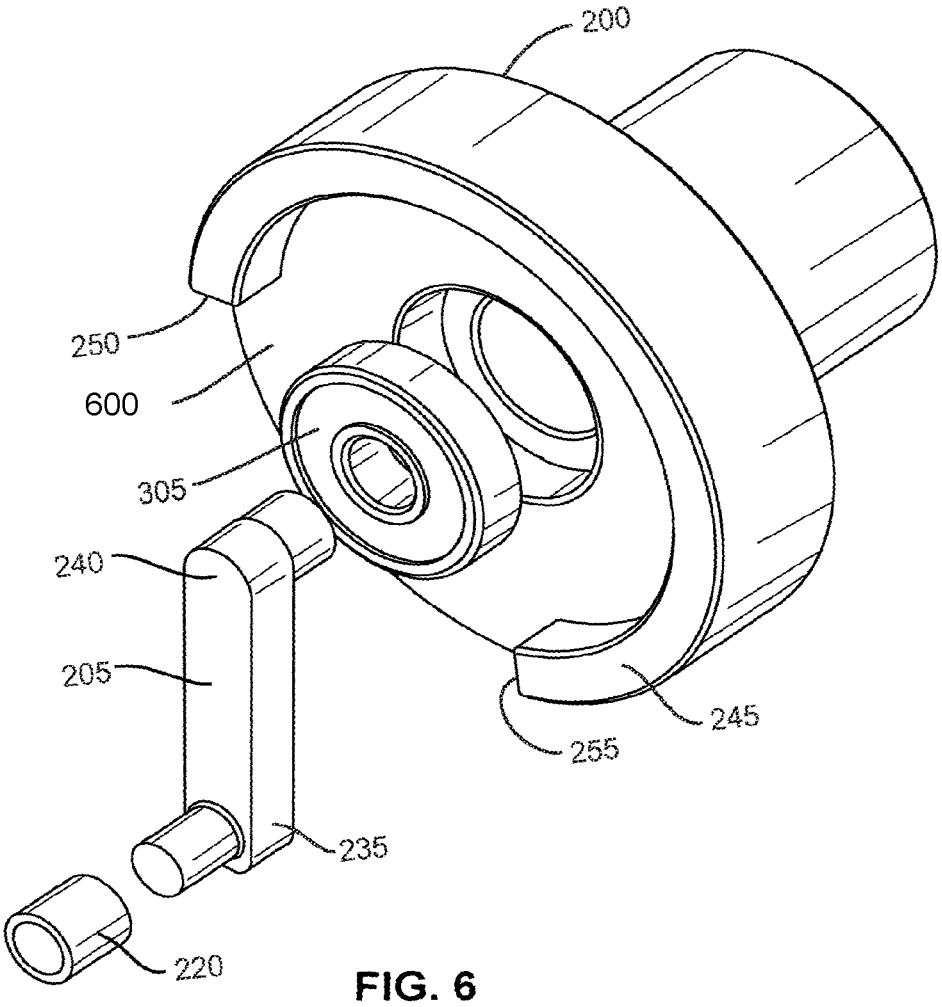
FIG. 6 is an exploded view of an exemplary spindle and swing arm, according to embodiments of the present technology.

FIG. 6 provides an exploded view of the spindle 200 and swing arm 205 portion of the impactor assembly 300 of FIG. 5 according to various embodiments. An inner face 600 of the spindle 200 may be adapted to receive the bearing 305. Referring back to FIG. 5, the inner face600 of the spindle 200 is disposed toward the anvil 100. The bearing 305, as described above, may be adapted to receive the secured end 240 of the swing arm 205. For the embodiments presented in FIGS. 2A through 2E, the bearing 305 may allow the swing arm 205 to freely rotate from the first swing arm stop 250 to the second swing arm stop 255. In other embodiments, however, the secured end 240 of the swing arm 205 may be fixedly attached to the spindle such that the swing arm 205 is not free to rotate.

Figure 7:
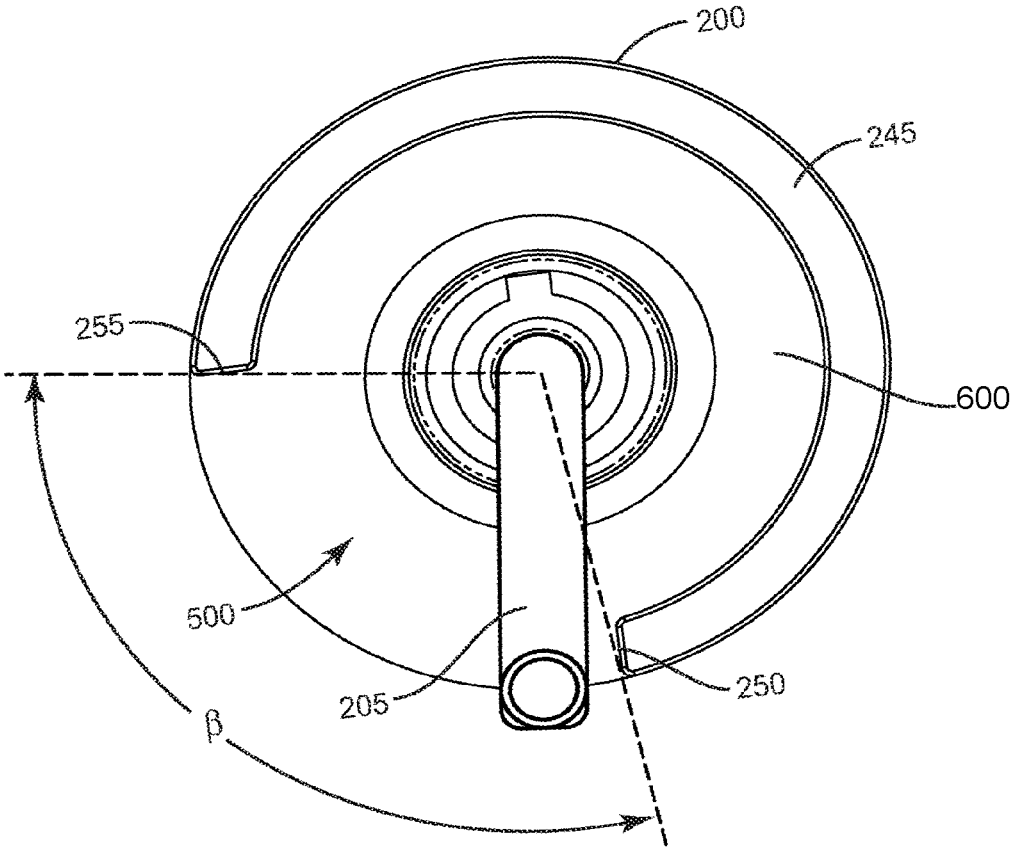
FIG. 7 is a front view of an exemplary spindle and swing arm, according to embodiments of the present technology.

A front view of the spindle is presented in FIG. 7 according to various embodiments. An angle β defined by a center of the spindle 200, the first swing arm stop 250, and the second swing arm stop 255 describes an opening 500 for the free movement of the swing arm 205. The angle β may range from a value such that the opening 500 just allows an interference fit of the swing arm 205 up to about 180 degrees while for other embodiments the opening 500 ranges from about 90 degrees to about 180 degrees. In other embodiments (not shown), the first swing arm stop 250 and the second swing arm stop 255 each comprise a separate post or leg structure extending outward from the spindle inner face 600.

Figure 8:
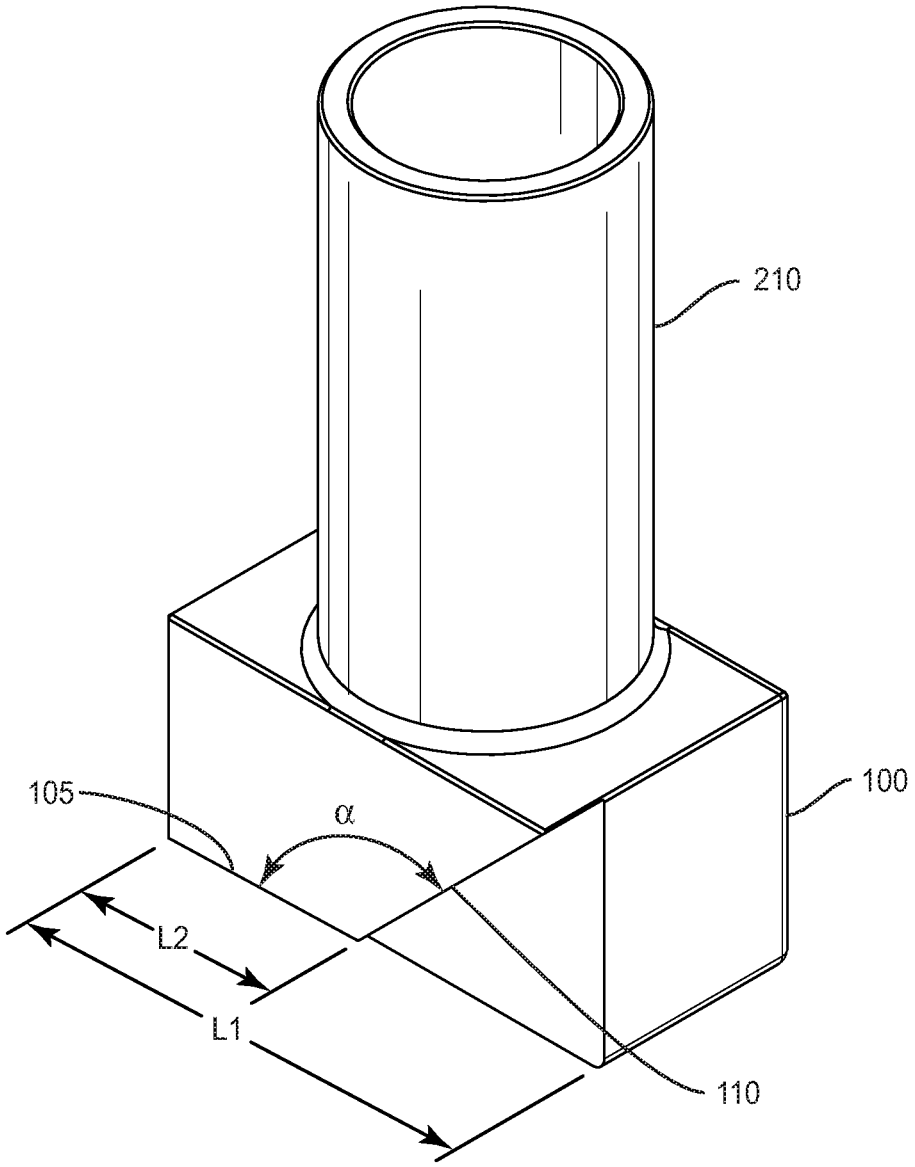
FIG. 8 is an isometric view of an exemplary anvil and piston, according to embodiments of the present technology.

FIG. 8 presents an isometric view of the anvil 100 and piston 210. In various embodiments, the piston 210 may be cylindrical as shown in FIG. 8, or the piston 210 may be oval, rectangular, triangular, or any other regular or irregular geometric shape necessary for a particular function. Likewise, the anvil 100 may take any shape necessary for its function. A length L2 of the contact surface 105 may be approximately half of a length L1 of the anvil 100. In various embodiments as illustrated in FIG. 8, the contact surface 105 and the ramp off surface 110 intersect. The angle α formed by the intersection of the contact surface 105 and the ramp off surface 110 may range from about 45 degrees to about 90 degrees. In various other embodiments (not shown), the contact surface 105 and the ramp off surface 110 may not intersect or the contact surface and the ramp off surface may be perpendicular to each other.

FIGS. 9A through 9D are schematic diagrams illustrating an exemplary swing arm being incorporated into a gear reducer, according to embodiments of the present technology. In various embodiments, the multiple roller swing arm (e.g., multiple roller swing arm 405) is incorporated into the gear reducer. The incorporation of the multiple roller swing arm 405 directly into the gear reducer as shown in FIGS. 9A through 9D provides advantages including energy and space savings. For example, energy is saved by eliminating the need for a separate spindle supported by separate bearings and seals. Additionally, incorporation of the multiple roller swing arm 405 directly into the gear reducer of the spindle eliminates drag. For instance, space is saved because incorporation of the multiple roller swing arm 405 directly into the gear reducer requires less parts (both moving parts and nonmoving parts). In some embodiments, the gear reducer may be a cycloidal gear reducer such as cycloidal gear reducer 905 shown in FIG. 9C. In some embodiments, the swing arm disengagement slot is cut into the gear disk allowing the gear reducer to function normally with the swing arm having the ability to rotate freely the required motion to move the piston engagement roller away from the piston (piston not shown). The disengagement slot allows for up to 30 degrees of motion (i.e., gear reducer backlash) translated to the swing arm.

Figure 9A:
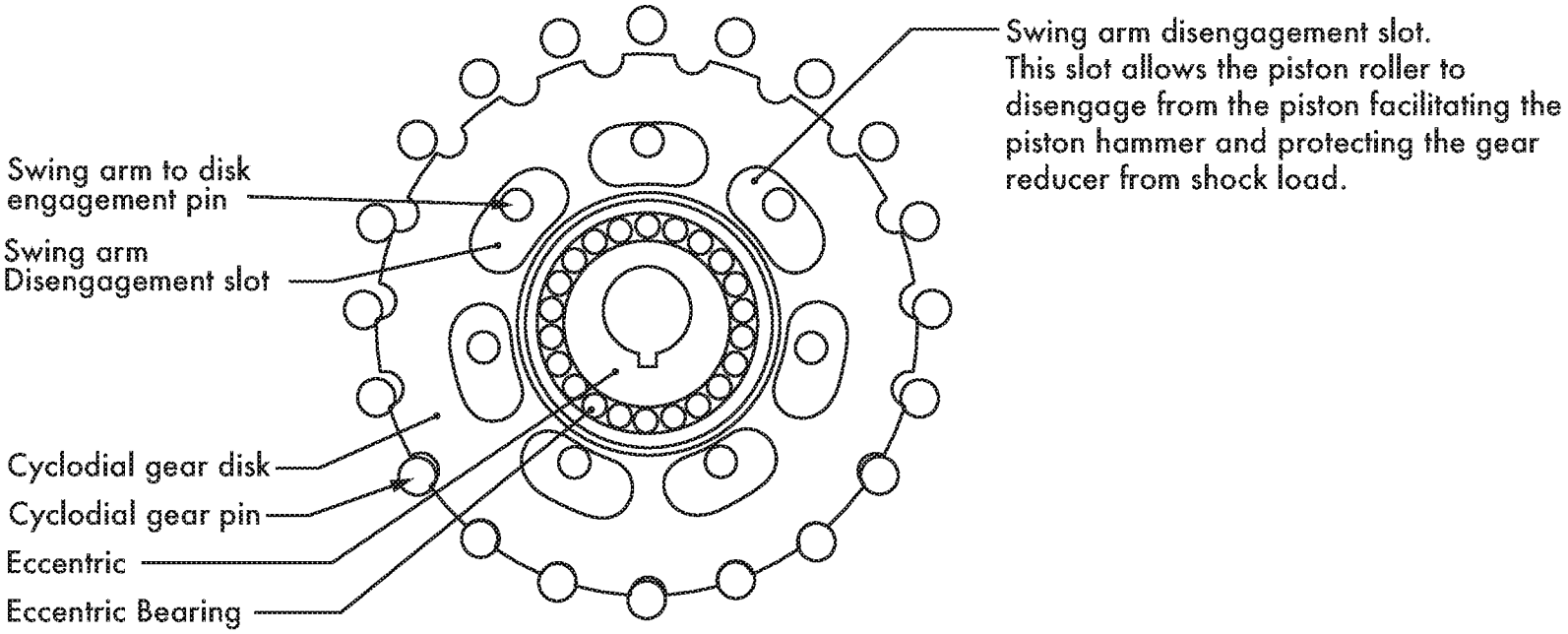
FIGS. 9A through 9D are schematic diagrams illustrating an exemplary swing arm being incorporated into a gear reducer, according to embodiments of the present technology.

FIG. 9A shows a swing arm to disk engagement pin, a swing arm disengagement slot, a cycloidal gear disk, a cycloidal gear pin, an eccentric, and an eccentric bearing. In various embodiments, the swing arm disengagement slot allows the swing arm to piston engagement roller to disengage from the piston allowing linear movement of the piston in the second direction opposite the first direction, thereby protecting the gear reducer from shock load and maximizing the travel distance of the piston in the second direction.

Figure 9B:
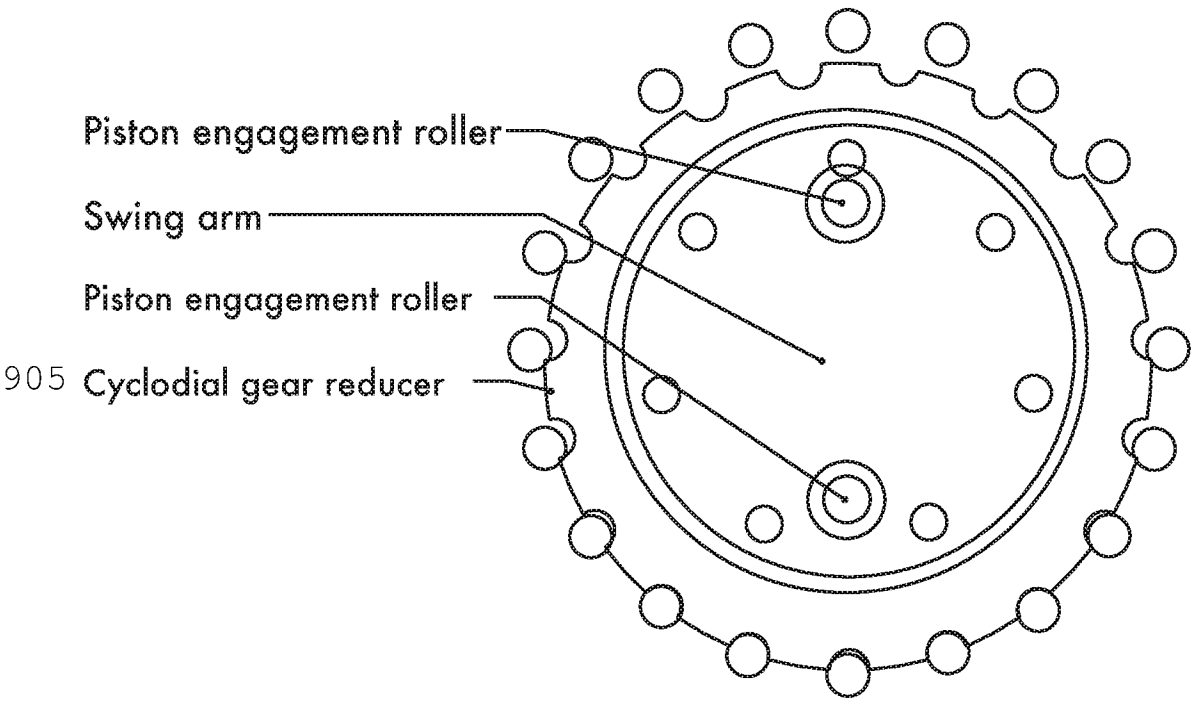

FIG. 9B shows two piston engagement rollers, the swing arm, and a cycloidal gear reducer 905. In various embodiments, the swing arm to piston engagement rollers (e.g., the first swing arm to piston engagement roller 410 and the second swing arm to piston engagement roller 415) operatively couple the swing arm and the piston.

Figure 9C:
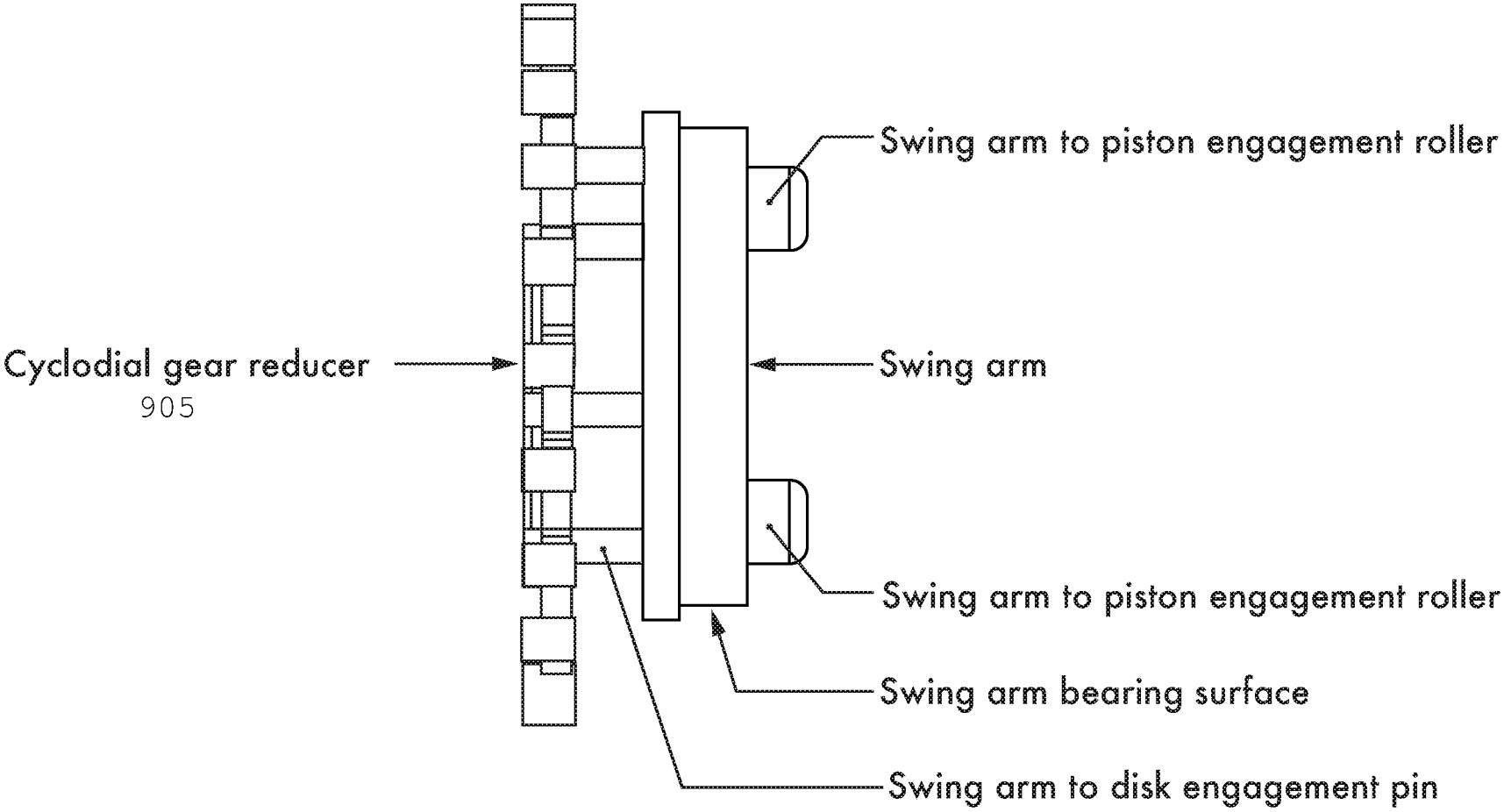
Figure 9D:
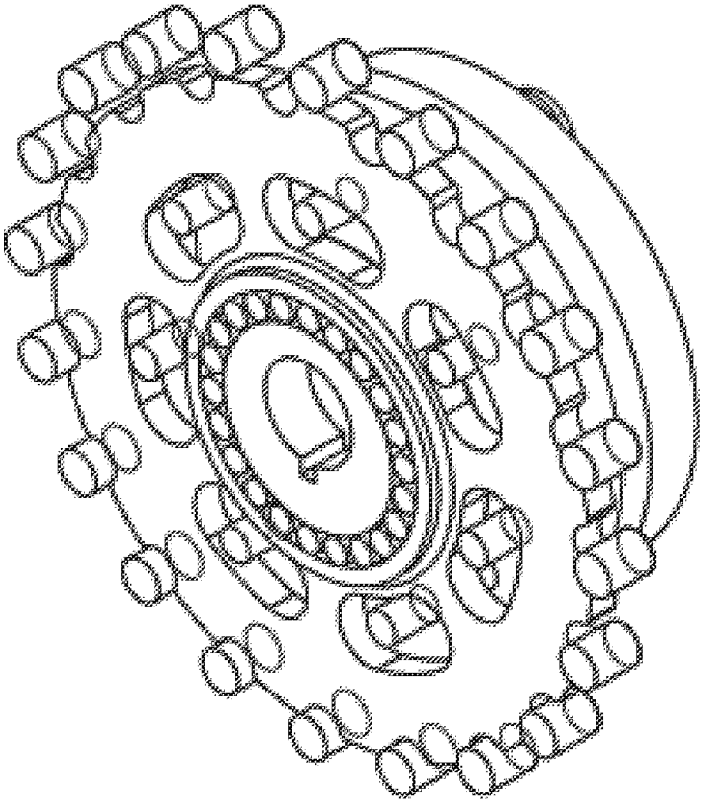

FIG. 9C shows a cycloidal gear reducer 905, swing arm to piston engagement rollers, a swing arm, a swing arm bearing surface, and a swing arm to disk engagement pin. In some embodiments, the swing arm is incorporated into the gear disk using a swing arm engagement pin, the swing arm engagement pin operatively coupling the swing arm and the swing arm disengagement slot. FIG. 9D shows a perspective view of the gear assembly. For example, a cycloidal gear reducer (e.g., cycloidal gear reducer 905).

Figure 10A:
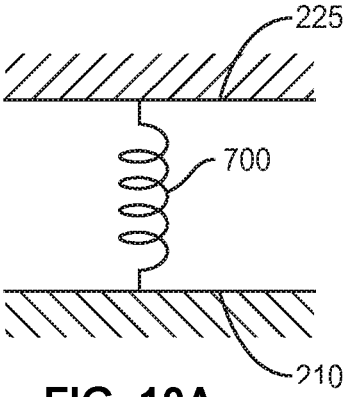
FIGS. 10A through 10E are schematic diagrams of exemplary energy storage media, according to embodiments of the present technology.
Figure 10B:
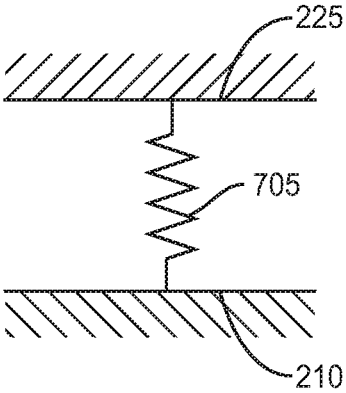
Figure 10C:
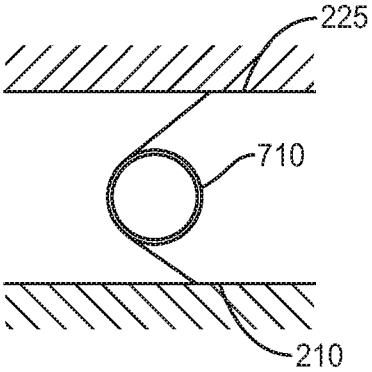
Figure 10D:
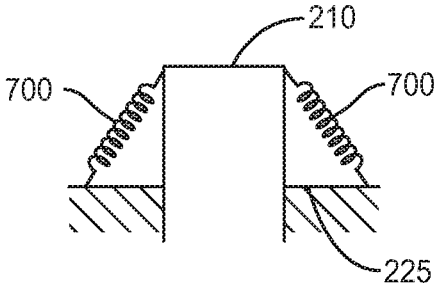
Figure 10E:
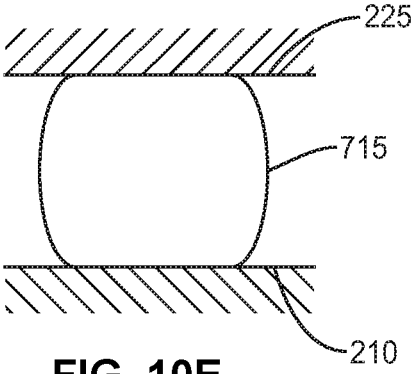

As described previously for FIGS. 2A through 2E, the housing 215 may comprise a chamber 225 for the energy storage medium. The energy storage medium may be any fluid, gas or device capable of resiliently storing and releasing energy. In certain embodiments, the energy storage medium is a gas that is compressed when the piston 210 enters the chamber 225. The compressed gas exerts a force F2 on the piston 210. In other embodiments, the energy storage medium is a mechanical device, such as a helical or coil spring 700 (FIG. 10A), a leaf spring 705 (FIG. 10B), a torsion spring 710 (FIG. 10C), or any other type of spring known in the art. While FIGS. 10A through 10C illustrate embodiments in which the springs 700, 705, 710 are in compression, FIG. 10D illustrates an embodiment where coil springs 700 are in tension. In addition to mechanical springs, a gas-filled bladder 715 (FIG. 10E) may be used as the energy storage medium. The energy storage media illustrated in FIGS. 10A through 10E are meant to be illustrative and are not intended to limit the scope of the present disclosure.

Figure 11A:
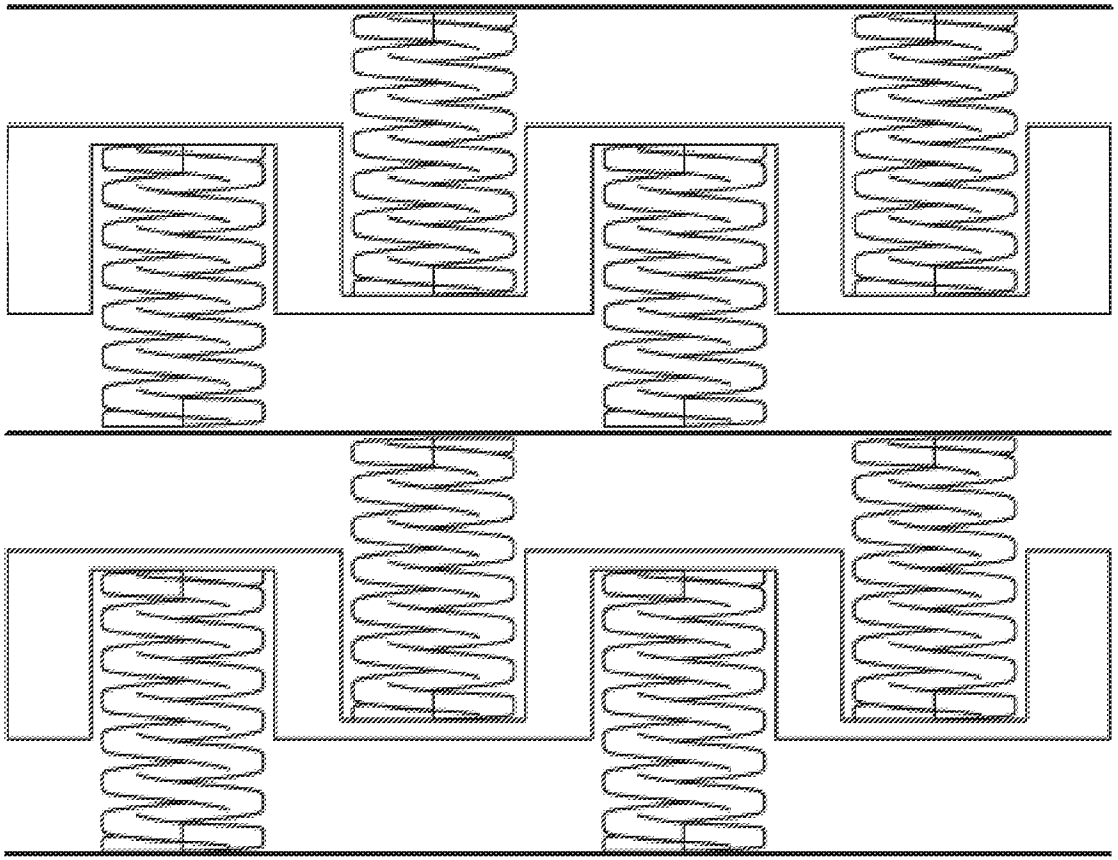
FIGS. 11A through 11C are schematic diagrams illustrating an exemplary energy storage medium being a compact spring assembly including spring stacks of a plurality of offset and counter sunk springs, according to embodiments of the present technology.
Figure 11B:
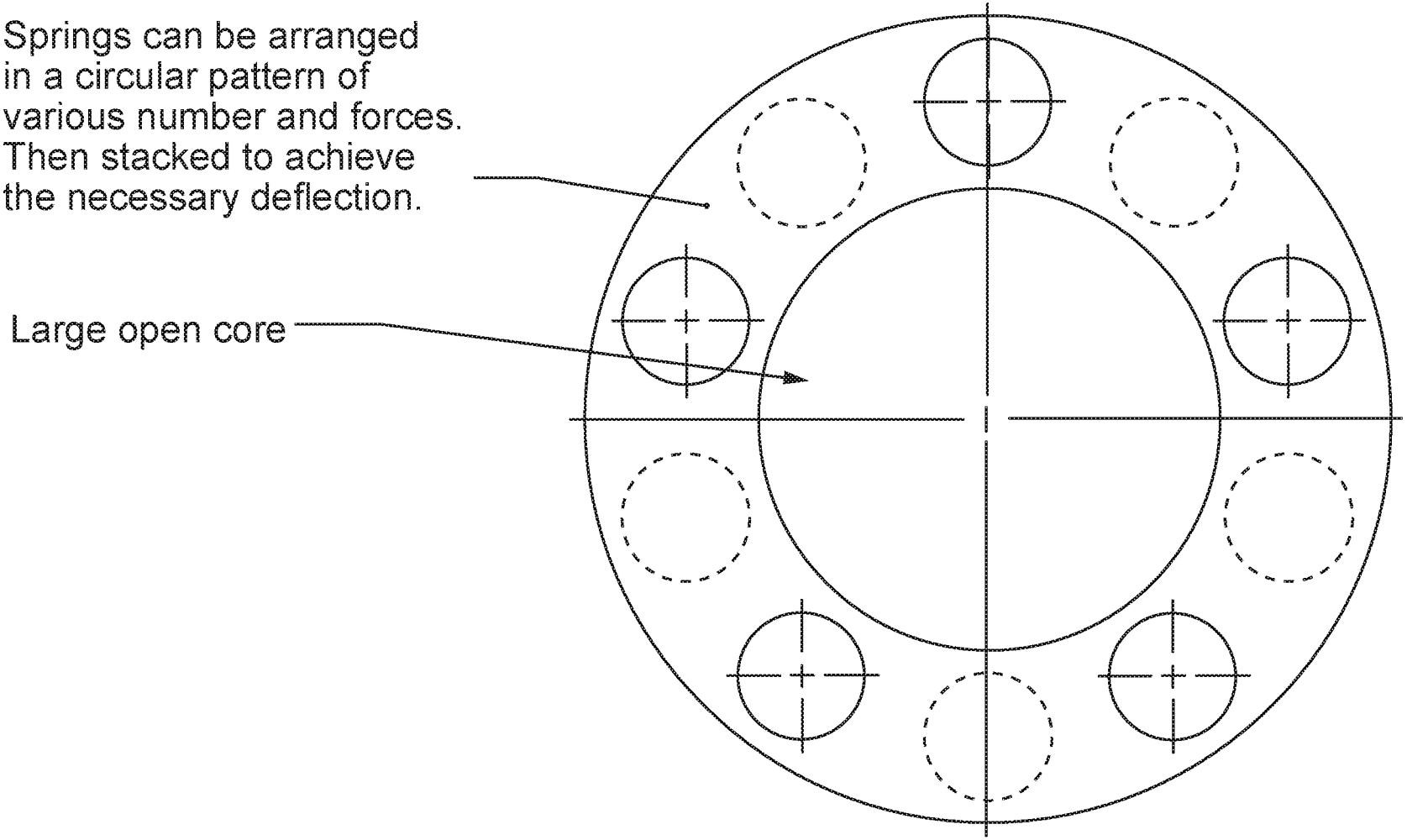
Figure 11C:
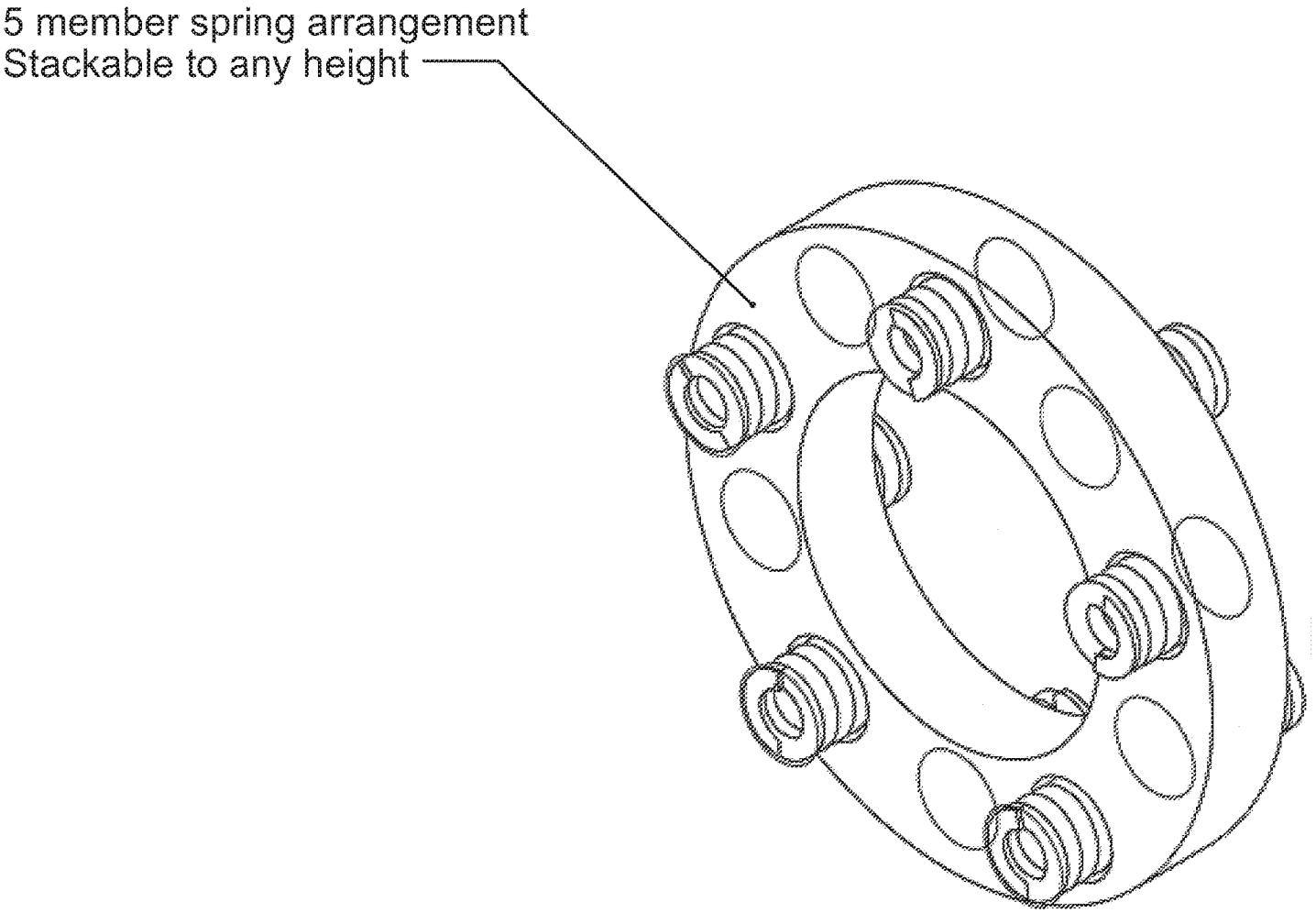

FIGS. 11A through 11C are schematic diagrams illustrating an exemplary energy storage medium (e.g., energy storage medium 370) being a compact spring assembly including spring stacks of a plurality of offset and counter sunk springs, according to embodiments of the present technology. For example, a spring arrangement may use compression springs of a small physical mass by placing multiple springs in a circular offset pattern with countersunk springs to greatly increase the energy storage capacity. The use of smaller springs in various embodiments, translates into decreased internal stress in the spring structure compared to larger springs. Decreased spring internal stress greatly increases useful life of the energy storage medium while saving space and producing a dense energy storage capacity. For example, an energy storage medium of high capacity that can function at cycles over 300 times per minute.

For example, large demolition hammers may require spring forces of up to 12,000 lbs. with deflections of 6 inches and spring cycling from 300 to 600 times per minute, all in a physical size restraint of less than 12 inches diameter and 48 inches in length. With these limitations, typical mechanical springs or spring arrangements cannot be fitted for use in these large hammers. To overcome these limitations, springs are offset and counter sunk allowing maximum use of spring deflection while minimizing spring free length.

FIG. 11A shows an offset and countersunk spring arrangement allowing maximum use of spring deflection while minimizing spring free length. The stacking springs in series in an offset, countersunk arrangement, has the advantage of using more springs in a given height which causes less deflection per spring, resulting in less stress, a flatter spring rate (i.e., 12 springs placed in series at 1,500 lbs. per inch each, drops to 125 lbs. per inch of deflection), superior controllability of the springs, less harmonics and ultimately sustainable spring life. For example, using springs that are 4 inches in height (i.e., 4 inch free length) with 4 stacks, the height would be 16 inches with an 8 inch deflection using a maximum spring deflection of 50 percent (typical). Using an offset and countersunk spring arrangement, the same springs would be 12 inches in height with an 8 inch deflection using 50 percent spring deflection. Furthermore, stacking 12 springs together results in the free length shortening from 48 inches to 36 inches. Thus, 12 inches shorter free length without any loss of deflection. Significantly, this allows use shorter/smaller springs which inherently have less internal stresses. Additionally, these springs are stacked and arranged to achieve large deflections with large forces that would otherwise not be obtainable or sustainable. In addition, the offset and countersunk spring arrangement allows the use of nested springs (one inside of another) while still maintaining a large open center that may be necessary for movement of the piston.

FIG. 11B shows the springs arranged in a circular pattern with a large open core, according to various embodiments. The springs can be arranged in a circular pattern with the open core, which is necessary for movement of the piston. Furthermore, the springs are stacked in series to achieve the necessary deflection.

FIG. 11C shows a five member spring arrangement according to various embodiments of the present technology that may be stackable to any potential height. For example, the five member arrangement (as shown) using nested springs with a rate 1,500 lbs. per inch each will result in a combined force of 7,500 lbs. Employing an eight member arrangement, 12,000 lbs. is obtained and controlled. The offset and countersunk spring arrangement allows the use of a large number of springs stacked in series to achieve the required deflection with a short free length height. Moreover, multiple spring stacks facilitate less movement of each individual spring resulting in sustainable spring life and a lesser spring rate per inch.

Figure 12A:
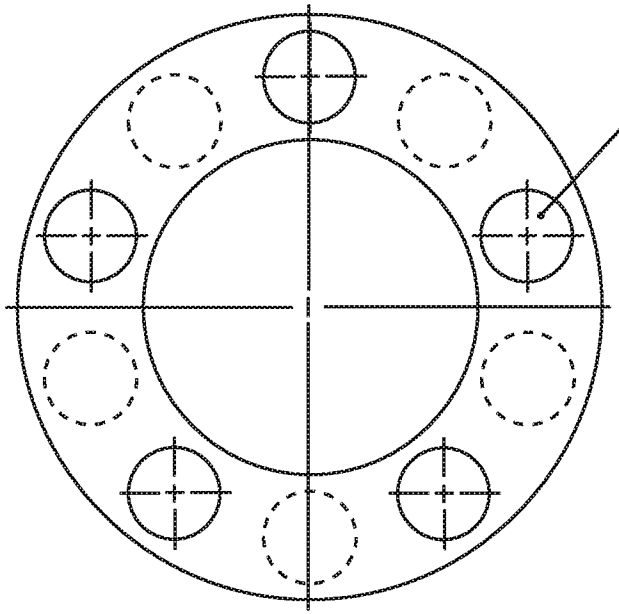
FIGS. 12A through 12C are additional schematic diagrams illustrating an exemplary energy storage medium being a compact spring assembly including spring stacks of a plurality of offset and counter sunk springs, according to embodiments of the present technology
Figure 12B:
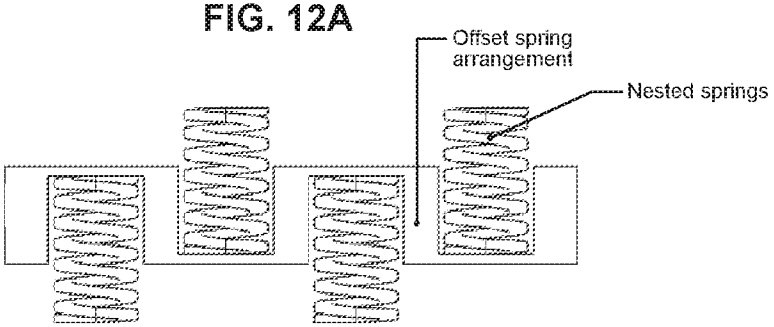
Figure 12C:
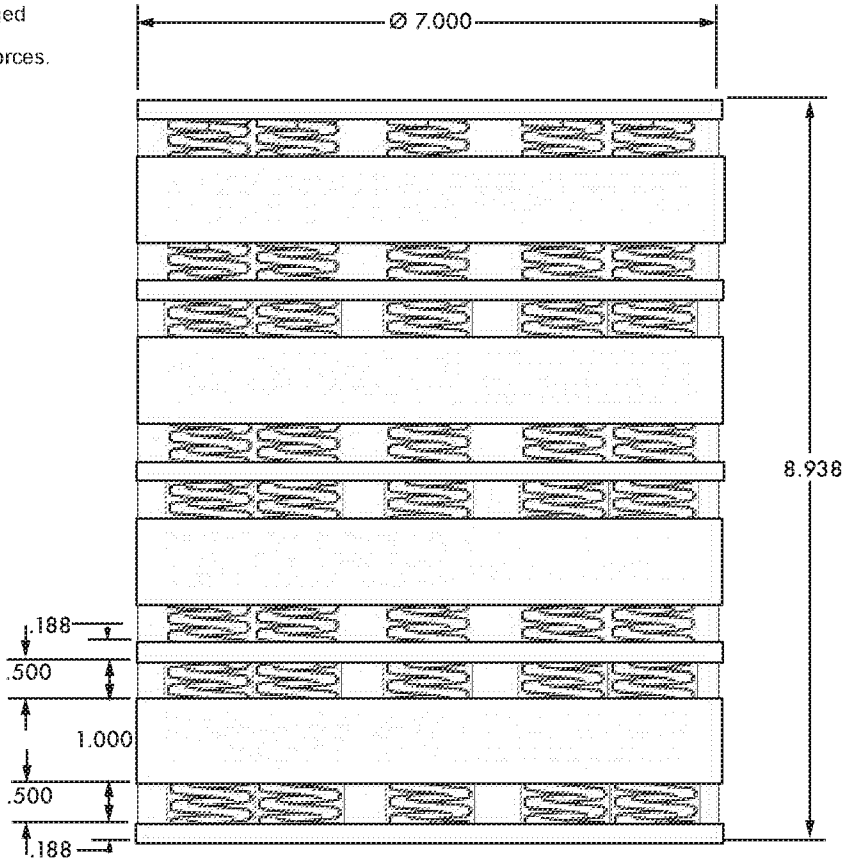

FIGS. 12A through 12C are additional schematic diagrams illustrating an exemplary energy storage medium being a compact spring assembly including spring stacks of a plurality of offset and counter sunk springs stacked in series, according to embodiments of the present technology. FIG. 12A shows the circular pattern with a large open core (as shown in FIG. 11B). FIG. 12B shows the offset and countersunk spring arrangement (as shown in FIG. 11A) allowing for the springs to be nested. FIG. 12C shows stacking of nested offset and countersunk springs in series (i.e., energy storage medium 370). For example, using nested springs to provide a spring rate of 1,500 lbs. per inch per spring. As shown in FIG. 12C, the compact spring assembly would have a force of 7,500 lbs. with a deflection rate of 937.5 lbs. per inch. Furthermore, the overall height would be 9 inches with a working deflection of 4 inches.

The simple structure of the embodiments disclosed leads to a highly energy efficient mechanism compared to other devices that perform similar functions. In addition to the emissions reductions, there are significant energy savings and further emissions reductions due to the decrease in petroleum products consumed.

Figure 13:
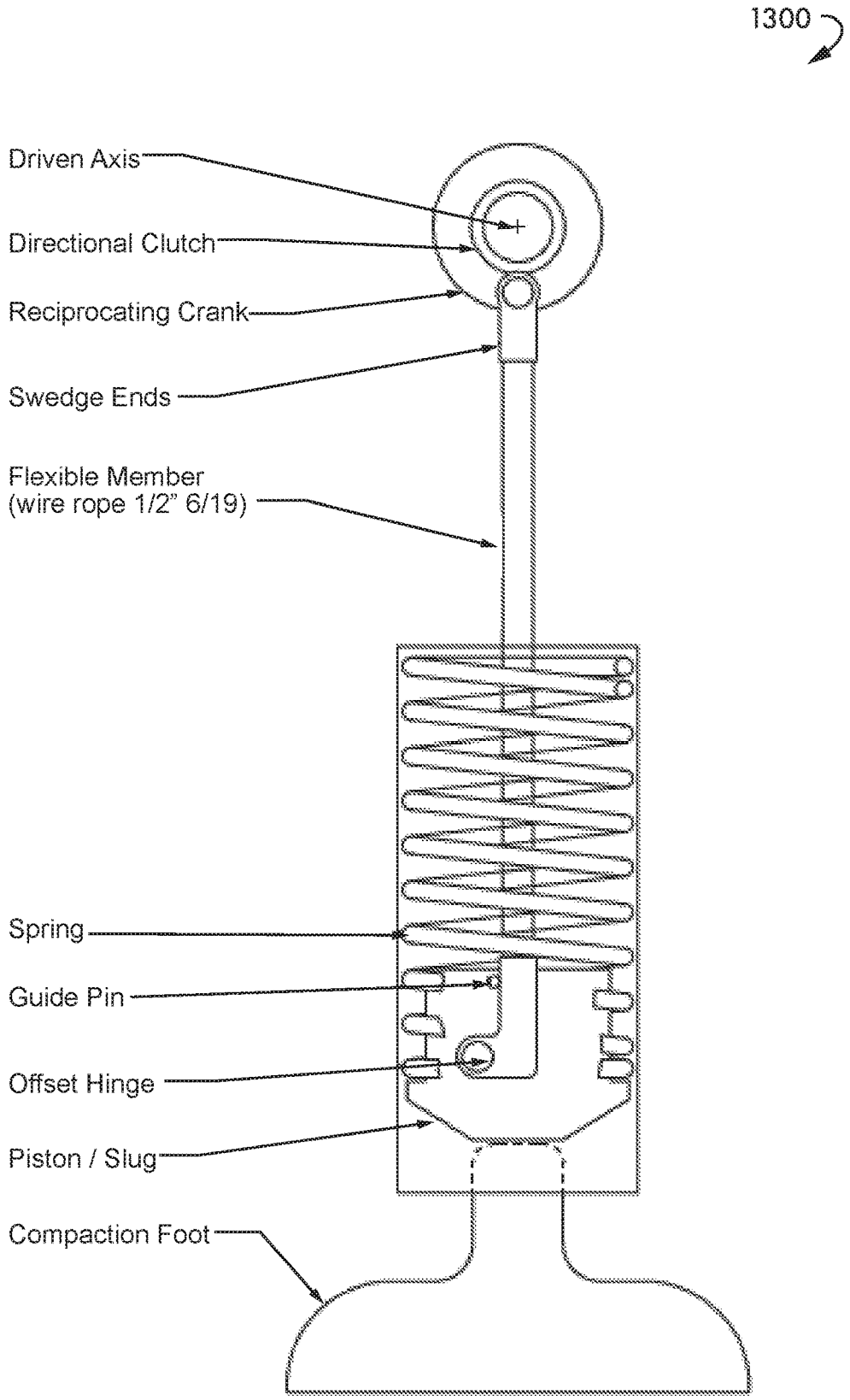
FIG. 13 is schematic diagram of pogo stick compactor, according to embodiments of the present technology.

FIG. 13 is schematic diagram of pogo stick compactor, according to embodiments of the present technology. In various embodiments, the pogo stick compactor includes a driven axis, a directional clutch, a reciprocating crank, a wedge ends, a flexible member, a spring, a guide pin, an offset hinge, a piston/slug, and a compaction foot. In various embodiments, operation of the pogo stick compactor includes the following steps. 1) The driven axis turns the directional clutch (over running clutch) in a counter clockwise (CCW) direction. 2) The reciprocating crank pulls on the flexible member causing the piston/slug to move upward compressing the spring. 3) As the reciprocating crank passes over top dead center, the directional clutch moves free continuing in the CCW direction allowing the spring to accelerate the piston/slug down striking the compaction foot. 4) As the reciprocating crank passes approximately 135 degrees of rotation, the piston/slug strikes the compaction foot and the flexible member "flexes" allowing the reciprocating crank to continue turning as the directional clutch reengages and the flexible member becomes taunt again, lifting the piston/slug and compressing the spring. 5) The offset hinge is used to tie the flexible member to the piston/slug via a solid dowel pin, as the piston/slug reaches the bottom limit of motion, the offset hinge with the CCW rotation of the reciprocating crank ensures that the flexible member flexes in the proper motion. 6) The guide pin is installed in the piston/slug and guides the offset hinge placement during the reciprocating motion.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. An impact hammer, comprising:

a spindle adapted for rotational movement;

a multiple roller swing arm comprising:

a first end, the first end comprising a first swing arm to piston engagement roller; and a second end, the second end comprising a second swing arm to piston engagement roller; and a piston comprising a piston contact surface adapted to contact the first swing arm to piston engagement roller such that rotation of the multiple roller swing arm causes the piston to move in a first direction along a linear path, the piston interacting with an energy storage medium when the multiple roller swing arm moves the piston in the first direction causing energy to be stored in the energy storage medium;

wherein continued rotation of the multiple roller swing arm causes the first swing arm to piston engagement roller to lose contact with the piston contact surface allowing the energy storage medium to urge the piston in a second direction opposite the first direction allowing the piston to strike an anvil impact surface for a first strike during a single rotation of the spindle;

wherein continued rotation of the multiple roller swing arm causes the second swing arm to piston engagement roller to make contact with the piston contact surface causing the piston to move in the first direction along the linear path, the piston interacting with the energy storage medium when the multiple roller swing arm moves the piston in the first direction causing energy to be stored in the energy storage medium; and wherein continued rotation of the multiple roller swing arm causes the second swing arm to piston engagement roller to lose contact with the piston contact surface allowing the energy storage medium to urge the piston in the second direction opposite the first direction allowing the piston to strike the anvil impact surface for a second strike during the single rotation of the spindle.

2. The impact hammer of claim 1, wherein the energy storage medium is a compound spring assembly, the compound spring assembly being a plurality of spring stacks, the plurality of spring stacks being a plurality of offset and counter sunk springs stacked in series, the plurality of offset and counter sunk springs stacked in series allowing for maximum use of spring deflection while minimizing spring free length.

3. The impact hammer of claim 2, wherein the plurality of offset and counter sunk springs stacked in series are arranged in a circular pattern, the circular pattern having an open core.

4. The impact hammer of claim 3, wherein the circular pattern of the plurality of offset and counter sunk springs stacked in series is five member spring arrangement.

5. The impact hammer of claim 1, wherein the first swing arm to piston engagement roller and the second swing arm to piston engagement roller are located 180 degrees apart along a linear axis such that the second swing arm to piston engagement roller is ready for engagement with the piston at the same time that the first swing arm to piston engagement roller loses contact with the piston contact surface and allowing the energy storage medium to urge the piston in a second direction opposite the first direction allowing the piston to strike the anvil impact surface for the first strike causing the piston to reach a limit of linear movement in the second direction allowing the second swing arm to piston engagement roller to engage the piston.

6. The impact hammer of claim 1, further comprising:

an anvil comprising the anvil impact surface adapted to contact the piston; and a work tool oriented within the linear path of the anvil such that the anvil makes contact with the work tool when the piston strikes the anvil impact surface.

7. The impact hammer of claim 1, wherein the multiple roller swing arm further comprises:

an attachment point, the attachment point being rotatably coupled to the spindle such that the rotational movement of the spindle is transferred to the multiple roller swing arm;

wherein the spindle further comprises a gear reducer; and wherein the attachment point of the multiple roller swing arm is incorporated into the gear reducer.

8. A device for saving energy by reducing a power requirement of an impact hammer, the device comprising:

a spindle adapted for rotational movement, the spindle comprising:

a gear reducer;

a multiple roller swing arm comprising:

a first end, the first end comprising a first swing arm to piston engagement roller; and a second end, the second end comprising a second swing arm to piston engagement roller; and a piston comprising a piston contact surface adapted to contact the first swing arm to piston engagement roller such that rotation of the multiple roller swing arm causes the piston to move in a first direction along a linear path, the piston interacting with an energy storage medium when the multiple roller swing arm moves the piston in the first direction causing energy to be stored in the energy storage medium, the energy storage medium being a compound spring assembly, the compound spring assembly being a plurality of spring stacks, the plurality of spring stacks being a plurality of offset and counter sunk springs stacked in series, the plurality of offset and counter sunk springs stacked in series allowing for maximum use of spring deflection while minimizing spring free length;

wherein continued rotation of the multiple roller swing arm causes the first swing arm to piston engagement roller to lose contact with the piston contact surface allowing the plurality of offset and counter sunk springs stacked in series of the compound spring assembly to urge the piston in a second direction opposite the first direction allowing the piston to strike an anvil impact surface for a first strike during a single rotation of the spindle;

wherein continued rotation of the multiple roller swing arm causes the second swing arm to piston engagement roller to make contact with the piston contact surface causing the piston to move in the first direction along the linear path, the piston interacting with the compound spring assembly when the multiple roller swing arm moves the piston in the first direction causing energy to be stored in the compound spring assembly; and wherein continued rotation of the multiple roller swing arm causes the second swing arm to piston engagement roller to lose contact with the piston contact surface allowing the plurality of offset and counter sunk springs stacked in series of the compound spring assembly to urge the piston in a second direction opposite the first direction allowing the piston to strike the anvil impact surface for a second strike during the single rotation of the spindle.

9. The device of claim of claim 8, wherein the plurality of offset and counter sunk springs stacked in series are arranged in a circular pattern, the circular pattern having an open core.

10. The device of claim of claim 9, wherein the circular pattern of the plurality of offset and counter sunk springs stacked in series is a five member spring arrangement.

11. The device of claim of claim 8, wherein the plurality of offset and counter sunk springs stacked in series includes nested springs, the nested springs allowing for additional springs in the compound spring assembly.

12. The device of claim 8, further comprising:

wherein the anvil impact surface is adapted to contact the piston; and a work tool oriented within the linear path of the anvil such that the anvil makes contact with the work tool when the piston strikes the anvil impact surface.

13. The device of claim 8, wherein the multiple roller swing arm further comprises:

an attachment point, the attachment point being rotatably coupled to the spindle such that the rotational movement of the spindle is transferred to the multiple roller swing arm, the attachment point being rotatably coupled to the spindle by being incorporated into the gear reducer of the spindle; and wherein the gear reducer further comprises:

a gear disk; and wherein the attachment point of the multiple roller swing arm is incorporated into the gear disk using a swing arm engagement pin.

14. The device of claim of claim 13, wherein the gear disk further comprises:

a swing arm disengagement slot, the swing arm disengagement slot allowing the first swing arm to piston engagement roller to disengage from the piston allowing linear movement of the piston in the second direction opposite the first direction, thereby protecting the gear reducer from shock load; and wherein the swing arm engagement pin operatively couples the multiple roller swing arm and the swing arm disengagement slot.

15. The device of claim of claim 14, wherein the swing arm disengagement slot is cut into the gear disk allowing the first swing arm to piston engagement roller to disengage from the piston.

16. The device of claim 8, wherein the gear reducer further comprises:

a gear disk; and a plurality of swing arm disengagement slots, the plurality of swing arm disengagement slots cut into the gear disk allowing the first swing arm to piston engagement roller and the second swing arm to piston engagement roller to disengage from the piston allowing linear movement of the piston in the second direction opposite the first direction, thereby protecting the gear reducer from shock load.

* * * * *